US012529367B2

(12) United States Patent
Kobayashi

(10) Patent No.: US 12,529,367 B2
(45) Date of Patent: Jan. 20, 2026

(54) TUBE HOLDING DEVICE, TUBE PUMP SYSTEM, AND TUBE INSTALLATION METHOD

(71) Applicant: Surpass Industry Co., Ltd., Saitama (JP)

(72) Inventor: Masamichi Kobayashi, Saitama (JP)

(73) Assignee: Surpass Industry Co., Ltd., Saitama (JP)

( * ) Notice: Subject to any disclaimer, the term of this patent is extended or adjusted under 35 U.S.C. 154(b) by 0 days.

(21) Appl. No.: 18/620,199

(22) Filed: Mar. 28, 2024

(65) Prior Publication Data

US 2024/0328409 A1 Oct. 3, 2024

(30) Foreign Application Priority Data

Mar. 30, 2023 (JP) ..... 2023-055283

(51) Int. Cl.
*F04B 43/12* (2006.01)
*F04B 43/00* (2006.01)
*F04B 53/22* (2006.01)

(52) U.S. Cl.
CPC ..... *F04B 43/1253* (2013.01); *F04B 43/0072* (2013.01); *F04B 53/22* (2013.01)

(58) Field of Classification Search
CPC ..... F04B 43/1253; F04B 43/1284; F04B 43/0072; F04B 53/22
See application file for complete search history.

(56) References Cited

U.S. PATENT DOCUMENTS 3,138,104 A * 6/1964 Cantor ..... F04B 43/1253 D24/111
3,591,319 A * 7/1971 Shlisky ..... F04B 43/1215 417/477.13

(Continued)

FOREIGN PATENT DOCUMENTS

EP 3689387 A1 8/2020
EP 3916229 A2 12/2021

(Continued)

OTHER PUBLICATIONS

Extended European Search Report dated Jul. 8, 2024 in corresponding application 24166831.8.

*Primary Examiner* — Nathan C Zollinger
(74) *Attorney, Agent, or Firm* — Muncy, Geissler, Olds & Lowe, P.C.

(57) ABSTRACT

Provided is a tube holding device configured to hold a tube to be installed to a tube pump including: a first installation part to which a first tube holding member configured to hold a first region of the tube is detachably installed; a second installation part to which a second tube holding member configured to hold a second region, which is different from the first region, of the tube is detachably installed; and a support part having a support face in a third region of the tube between the first region and the second region with the first tube holding member being installed to the first installation part and the second tube holding member being installed to the second installation part, the support face being configured to support a part of an outer circumferential face of the tube and having a substantially semicircular shape in sectional view.

5 Claims, 18 Drawing Sheets

(56) References Cited

U.S. PATENT DOCUMENTS 3,756,752 A * 9/1973 Stenner ..... F04B 43/1253 226/91
3,875,970 A * 4/1975 Fitter ..... F04B 43/0072 417/477.9
4,537,561 A * 8/1985 Xanthopoulos ... A61M 5/14232 D24/111
5,433,588 A * 7/1995 Monk ..... F04B 43/1253 417/477.2
5,927,956 A * 7/1999 Lim ..... A61M 3/0258 417/477.13
5,971,726 A * 10/1999 Yoshida ..... F04B 43/1253 417/477.1
6,468,059 B2 * 10/2002 Haser ..... A61M 3/0258 417/477.2
7,214,038 B2 * 5/2007 Saxer ..... A61M 5/14232 417/477.2
8,047,819 B2 * 11/2011 Lawrence ..... F16L 3/1033 417/477.2
8,182,241 B2 * 5/2012 Fulmer ..... F04B 43/1253 417/477.1
8,377,001 B2 * 2/2013 Pfouts ..... A61M 5/14232 417/477.2
D699,836 S * 2/2014 Burger ..... D24/111
9,103,340 B2 * 8/2015 Wagner ..... F04B 43/1292
D762,850 S * 8/2016 Harr ..... D24/129
9,421,322 B2 * 8/2016 Breitweiser ..... A61M 5/16831
10,113,524 B2 * 10/2018 Naumann ..... B29C 45/14622
2004/0057856 A1 3/2004 Saxer et al.
2012/0213653 A1 8/2012 Wagner
2013/0315763 A1 * 11/2013 Neoh ..... F04B 43/0081 417/474
2017/0096995 A1 * 4/2017 Imai ..... F04B 43/12
2020/0230307 A1 7/2020 Sonoda et al.
2021/0239108 A1 8/2021 Imai
2021/0372393 A1 12/2021 Imai
2023/0065913 A1 3/2023 Sharpstone et al.
2024/0068464 A1 2/2024 Sonoda et al.
2025/0180004 A1 * 6/2025 Falkum ..... F04B 53/22

FOREIGN PATENT DOCUMENTS

JP 2021-121738 A 8/2021
WO WO-2011057663 A1 * 5/2011 ..... F04B 43/1253

* cited by examiner

TUBE HOLDING DEVICE, TUBE PUMP SYSTEM, AND TUBE INSTALLATION METHOD

CROSS-REFERENCE TO RELATED APPLICATIONS

This application claims foreign priority benefits under U.S.C. § 119 to Japanese Patent Application No. 2023-055283 filed on Mar. 30, 2023, the contents of which is hereby incorporated by reference in its entirety.

BACKGROUND

1. Technical Field

The present disclosure relates to a tube holding device, a tube pump system, and a tube installation method.

2. Description of Related Art

Tube pumps that intermittently collapse a flexible tube between a plurality of rollers and thereby transport a liquid contained in the tube are conventionally known (for example, see Japanese Patent Application Laid-Open No. 2021-121738). The tube pump disclosed in Japanese Patent Application Laid-Open No. 2021-121738 is structured such that both a first roller part and a second roller part, which are rotated about an axis while being in contact with the tube, are rotatable about the axis, respectively, independently.

Further, when both the first roller part and the second roller part are being rotated about the axis, in case the operator accidentally touches a part near the first roller part and the second roller part by its hand, the operator's finger may be caught between the first roller part and the second roller part. If the first roller part and the second roller part are covered so that the operator is unable to touch the part nearby by its hand, however, this will inhibit easy replacement of the tube.

In the tube pump of Japanese Patent Application Laid-Open No. 2021-121738, a tube is arranged in an accommodation part, an annular opening region is provided in the accommodation part to enable insertion of a tube toward the inner circumferential face thereof, and a cover member is arranged over the accommodation part. This prevents the operator's finger from being caught between a pair of roller parts. Further, the operator is able to insert the tube toward the inner circumferential face of the accommodation part from the opening region.

In the tube pump of Japanese Patent Application Laid-Open No. 2021-121738, however, it may be relatively difficult for the operator to directly pinch and insert a tube toward the inner circumferential face of the accommodation part of the tube pump. For example, when there is deformation in the tube such as when the tube to be installed to the tube pump is partially twisted, this will require operation to release the deformation of the tube.

BRIEF SUMMARY

The present disclosure has been made in view of such circumstances and intends to provide a tube holding device, a tube pump system, and a tube installation method that can facilitate operation of installing a tube to a tube pump.

The present disclosure employs the following solutions in order to achieve the above object.

A tube holding device according to one aspect of the present disclosure is a device configured to hold a tube to be installed to a tube pump, the tube holding device includes: a first installation part to which a first tube holding member configured to hold a first region of the tube is detachably installed; a second installation part to which a second tube holding member configured to hold a second region of the tube is detachably installed, the second region being different from the first region; and a support part having a support face in a third region of the tube between the first region and the second region with the first tube holding member being installed to the first installation part and the second tube holding member being installed to the second installation part, the support face being configured to support a part of an outer circumferential face of the tube and having a substantially semicircular shape in sectional view.

According to the tube holding device of one aspect of the present disclosure, the first tube holding member configured to hold the first region of the tube is installed to the first installation part, and the second tube holding member configured to hold the second region of the tube is installed to the second installation part. In this state, a part of the outer circumferential face of the tube is supported by the support face of the support part in the third region of the tube between the first region and the second region. Since the support face has a substantially semicircular shape, this results in a state where substantially a half of the region on the outer circumferential face of the third region of the tube is supported by the support face. Accordingly, the tube is maintained in a constant shape from the first region to the second region without causing deformation such as twisting of the tube.

Further, according to the tube holding device of one aspect of the present disclosure, in a state where the tube has been moved to a desired position for installation to the tube pump, the first tube holding member is detached from the first installation part, the second tube holding member is detached from the second installation part, and thereby the state where a part of the outer circumferential face of the third region of the tube is supported by the support face is released. This enables the operator to easily perform the operation to install the tube at a desired position of the tube pump.

The tube holding device according to one aspect of the present disclosure is preferably configured such that the first installation part and the second installation part are arranged on one end side in a longitudinal direction of the tube holding device, the support part is arranged on the other end side in the longitudinal direction so that the support face faces the other end side in the longitudinal direction, the first installation part has a first insertion hole configured such that the first tube holding member is inserted in the first insertion hole from the other end side to the one end side in the longitudinal direction and a first wall part configured to inhibit the first tube holding member inserted in the first insertion hole from moving from the other end side to the one end side, and the second installation part has a second insertion hole configured such that the second tube holding member is inserted in the second insertion hole from the other end side toward the one end side in the longitudinal direction and a second wall part configured to inhibit the second tube holding member inserted in the second insertion hole from moving from the other end side to the one end side.

According to the tube holding device of the present configuration, it is possible to install the tube to the tube holding device by inserting the first tube holding member into the first insertion hole from the other end side toward the one end side in the longitudinal direction and inserting the second tube holding member into the second insertion hole from the other end side toward the one end side in the longitudinal direction. Further, since the first installation part has the first wall part, this inhibits the first tube holding member inserted in the first insertion hole from moving from the other end side to the one end side. Similarly, since the second installation part has the second wall part, this inhibits the second tube holding member inserted in the second insertion hole from moving from the other end side to the one end side.

According to the tube holding device of the present configuration, when the tube holding device is moved from the other end side toward the one end side in the longitudinal direction in a state where the positions of the first tube holding member and the second tube holding member are fixed, the first tube holding member comes out of the first insertion hole, and the state where the first tube holding member is installed to the first installation part is released. Similarly, the second tube holding member comes out of the second insertion hole, and the state where the second tube holding member is installed to the second installation part is released. Then, the first tube holding member is detached from the first installation part, the second tube holding member is detached from the second installation part, and thereby the state where a part of the outer circumferential face of the third region of the tube is supported by the support face is released. This enables the operator to easily perform the operation to install the tube at a desired position of the tube pump via an easy operation of moving the tube holding device from the other end side toward the one end side in the longitudinal direction.

The tube holding device according to one aspect of the present disclosure is preferably configured such that the first installation part and the second installation part are arranged apart from each other in a width direction orthogonal to the longitudinal direction, and the support part is arranged at a position offset from the first installation part and the second installation part in a height direction orthogonal to the longitudinal direction and the width direction.

According to the tube holding device of the present configuration, the support part is arranged at a position offset from the first installation part and the second installation part in the height direction. Thus, at a position where the third region of the tube is suitably spaced apart from the tube pump, the operator is able to release the state where the third region of the tube is supported by the support face.

The tube holding device according to one aspect of the present disclosure preferably configured to have a main body to which the first installation part, the second installation part, and the support part are connected, respectively, and the first installation part, the second installation part, the support part, and the main body is preferably, integrally formed of a resin material.

According to the tube holding device of the present configuration, since the first installation part, the second installation part, the support part, and the main body are integrally formed of a resin material, it is possible to easily and reliably hold the tube without performing another operation of positioning of each part or the like.

A tube pump system according to one aspect of the present disclosure is a tube pump system including: a tube; a tube pump configured to transport a liquid inside the tube; a tube holding device configured to hold the tube to be installed to the tube pump; a first tube holding member configured to hold a first region of the tube; and a second tube holding member configured to hole a second region of the tube, the second region being different from the first region. The tube pump has an accommodation part having an inner circumferential face for the tube to be arranged in an arc shape about an axis, and a roller part accommodated in the accommodation part and configured to be rotated about the axis with the tube being blocked. A first insertion groove in which the first tube holding member is inserted and a second insertion groove in which the second tube holding member is inserted are formed in the accommodation part. The tube holding device has a first installation part to which the first tube holding member is detachably installed, a second installation part to which the second tube holding member is detachably installed, and a support part having a support face in a third region of the tube between the first region and the second region with the first tube holding member being installed to the first installation part and the second tube holding member being installed to the second installation part, the support face being configured to support a part of an outer circumferential face of the tube and having a substantially semicircular shape in sectional view. The first tube holding member is installed to the first installation part and the second tube holding member is installed to the second installation part so that an insertion operation to insert the first tube holding member installed to the first installation part into the first insertion groove and an insertion operation to insert the second tube holding member installed to the second installation part into the second insertion groove are able to be performed at the same time.

According to the tube pump system of one aspect of the present disclosure, the first tube holding member configured to hold the first region of the tube is installed to the first installation part, and the second tube holding member configured to hold the second region of the tube is installed to the second installation part. In this state, a part of the outer circumferential face of the tube is supported by the support face of the support part in the third region of the tube between the first region and the second region. Since the support face has a substantially semicircular shape, this results in a state where substantially a half of the region on the outer circumferential face of the third region of the tube is supported by the support face. Accordingly, the tube is maintained in a constant shape from the first region to the second region without causing deformation such as twisting of the tube.

Further, according to the tube pump system of one aspect of the present disclosure, the insertion operation to insert the first tube holding member installed to the first installation part of the tube holding device into the first insertion groove and the insertion operation to insert the second tube holding member installed to the second installation part of the tube holding device into the second insertion groove can be performed at the same time.

Then, when the tube holding device is moved from the other end side toward the one end side in the longitudinal direction in a state where the first tube holding member and the second tube holding member are fixed to the accommodation part of the tube pump, the first tube holding member comes out of the first insertion hole, and the state where the first tube holding member is installed to the first installation part is released. Similarly, the second tube holding member comes out of the second insertion hole, and the state where the second tube holding member is installed to the second installation part is released.

Then, the first tube holding member is detached from the first installation part, the second tube holding member is detached from the second installation part, and thereby the state where a part of the outer circumferential face of the third region of the tube is supported by the support face is released. This enables the operator to easily perform the operation to install the tube at a desired position of the tube pump via an easy operation of moving the tube holding device from the other end side toward the one end side in the longitudinal direction.

A tube installation method according to one aspect of the present disclosure of the above configuration is a method for installing a tube to a tube pump by using a tube holding device. The tube holding device has a first installation part to which a first tube holding member is detachably installed, a second installation part to which a second tube holding member is detachably installed, and a support part having a support face in a third region of the tube between the first region and the second region with the first tube holding member being installed to the first installation part and the second tube holding member being installed to the second installation part, the support face being configured to support a part of an outer circumferential face of the tube and having a substantially semicircular shape in sectional view. The tube pump has an accommodation part having an inner circumferential face for the tube to be arranged in an arc shape about an axis, and a roller part accommodated in the accommodation part and configured to be rotated about the axis with the tube being blocked. A first insertion groove in which the first tube holding member configured to hold the first region of the tube is inserted and a second insertion groove in which the second tube holding member configured to hole the second region of the tube is inserted are formed in the accommodation part. The tube installation method includes: an installation step of installing the first tube holding member to the first installation part and installing the second tube holding member to the second installation part so that an insertion operation to insert the first tube holding member installed to the first installation part into the first insertion groove and an insertion operation to insert the second tube holding member installed to the second installation part into the second insertion groove are able to be performed at the same time; an insertion step of inserting the first tube holding member installed to the first installation part into the first insertion groove and inserting the second tube holding member installed to the second installation part into the second insertion groove; and a releasing step of detaching, from the first installation part, the first tube holding member inserted in the first insertion groove, detaching, from the second installation part, the second tube holding member inserted in the second insertion groove, and releasing a state where the third region of the tube is supported by the support face.

According to the tube installation method of one aspect of the present disclosure, in the installation step, the first tube holding member configured to hold the first region of the tube is installed to the first installation part, and the second tube holding member configured to hold the second region of the tube is installed to the second installation part. In this state, a part of the outer circumferential face of the tube is supported by the support face of the support part in the third region of the tube between the first region and the second region. Since the support face has a substantially semicircular shape, this results in a state where substantially a half of the region on the outer circumferential face of the third region of the tube is supported by the support face. Accordingly, the tube is maintained in a constant shape from the first region to the second region without causing deformation such as twisting of the tube.

Further, according to the tube installation method of one aspect of the present disclosure, in the insertion step, the insertion operation to insert the first tube holding member installed to the first installation part of the tube holding device into the first insertion groove and the insertion operation to insert the second tube holding member installed to the second installation part of the tube holding device into the second insertion groove can be performed at the same time.

Then, the first tube holding member is detached from the first installation part, the second tube holding member is detached from the second installation part, and thereby the state where a part of the outer circumferential face of the third region of the tube is supported by the support face is released. This enables the operator to easily perform the operation to install the tube at a desired position of the tube pump.

According to the present disclosure, a tube holding device, a tube pump system, and a tube installation method that can facilitate operation for installing a tube to a tube pump can be provided.

DETAILED DESCRIPTION

Figure 1:
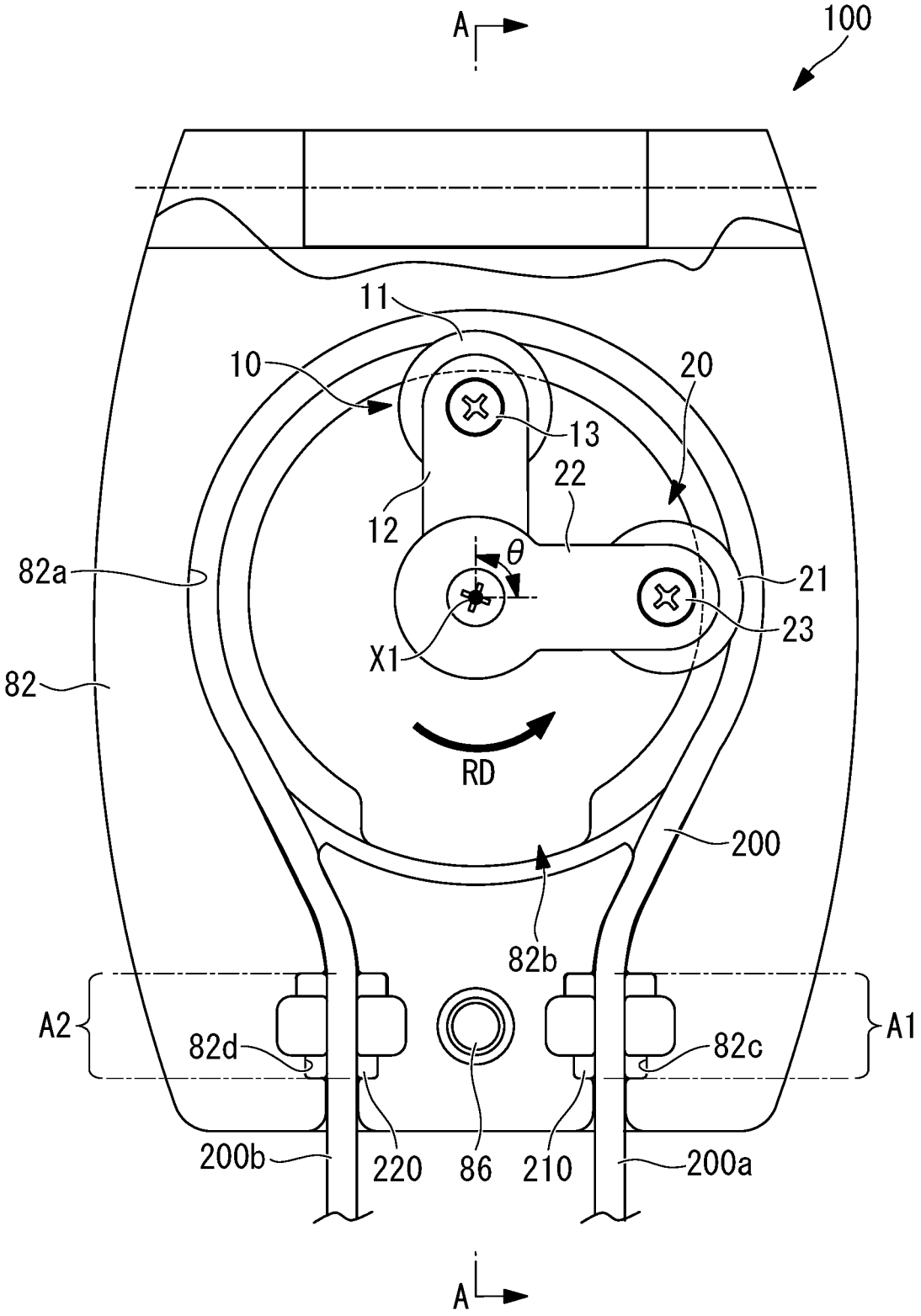
FIG. 1 is a plan view illustrating one embodiment of a tube pump in an ejection control mode.
Figure 2:
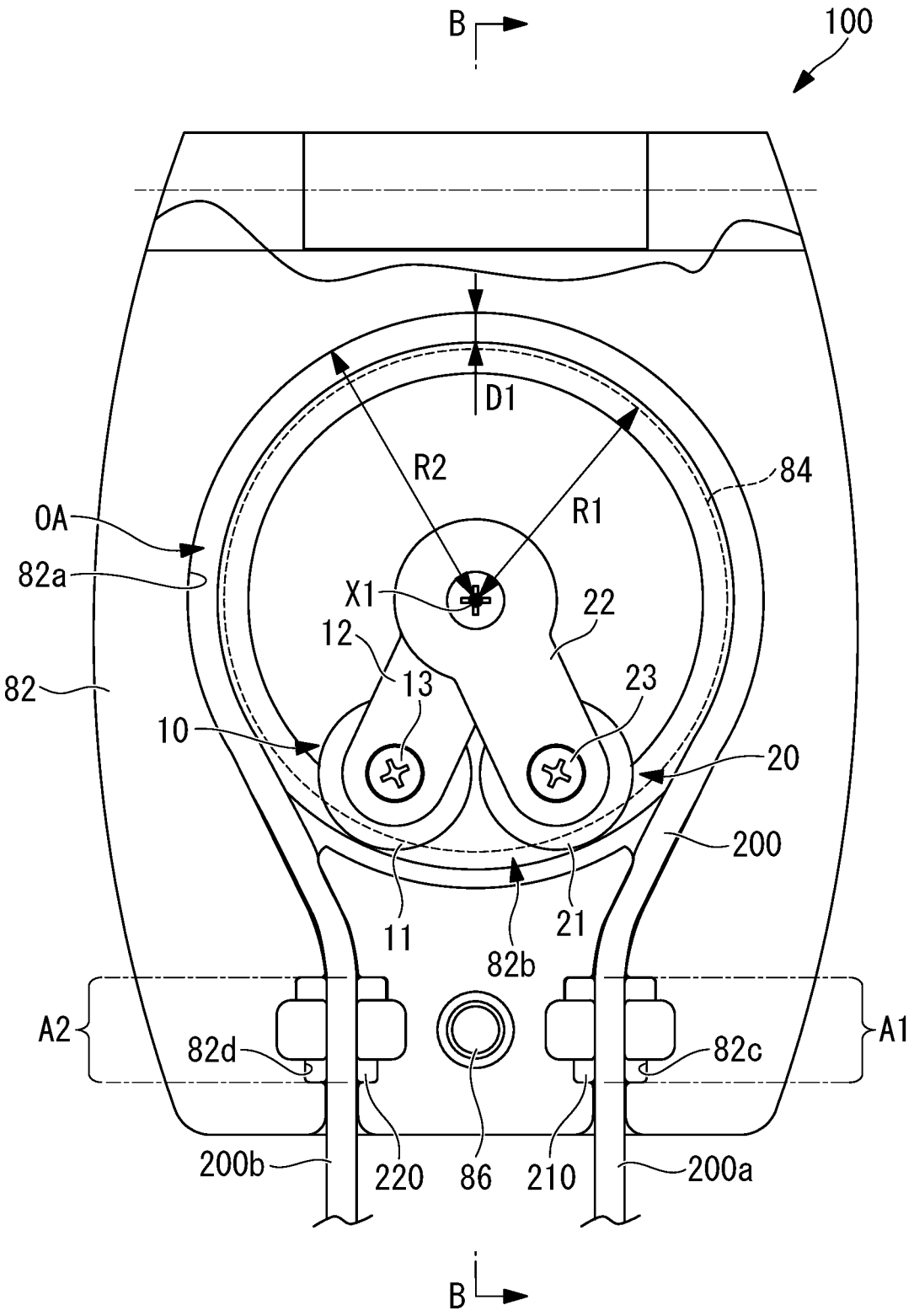
FIG. 2 is a plan view illustrating one embodiment of the tube pump in a tube replacement mode.

A tube pump (peristaltic pump) 100 and a tube holding device 300 that holds a tube 200 to be installed to the tube pump 100 of one embodiment of the present disclosure will be described below with reference to the drawings. FIG. 1 is a plan view illustrating one embodiment of the tube pump in an ejection control mode. FIG. 2 is a plan view illustrating one embodiment of the tube pump in a tube replacement mode. In FIG. 1, depiction of a cover member 84 and a lid 85 illustrated in FIG. 4 and FIG. 5 described later will be omitted. In FIG. 2, the cover member 84 is illustrated by the dotted line, and the depiction of the lid 85 is omitted.

The tube pump 100 of the present embodiment illustrated in FIG. 1 is a device that rotates a first roller part 10 and a second roller part 20 about an axis X1 in the same direction to transport a fluid contained in the tube 200 flowing therein from an inflow side 200*a* to an outflow side 200*b*. The tube 200 is formed of a flexible resin material (for example, vinyl chloride).

As illustrated in the plan view of FIG. 1, in the tube pump 100, the tube 200 is arranged in an arc shape about the axis X1 along an inner circumferential face 82*a* of an accommodation part 82 that accommodates the first roller part 10 and the second roller part 20. The inner circumferential face 82*a* is a surface that is formed in an arc shape about the axis X1 and on which the tube 200 is arranged. The accommodation part 82 has a recess 82*b* that is opened toward one end side in the axis direction along the axis X1 and accommodates the first roller part 10 and the second roller part 20.

As illustrated in FIG. 1, the first roller part 10 and the second roller part 20 accommodated in the accommodation part 82 are rotated about the axis X1 in a counterclockwise rotation direction RD while being in contact with the tube 200.

As illustrated in FIG. 1, a first tube holding member 210 that holds a first region A1 of the tube 200 and a second tube holding member 220 that holds a second region A2 of the tube 200 are installed to the tube 200. The second region A2 is a region different from the first region A1. In the accommodation part 82, a first insertion groove 82*c* in which the first tube holding member 210 is inserted and a second insertion groove 82*d* in which the second tube holding member 220 is inserted are formed.

Figure 3:
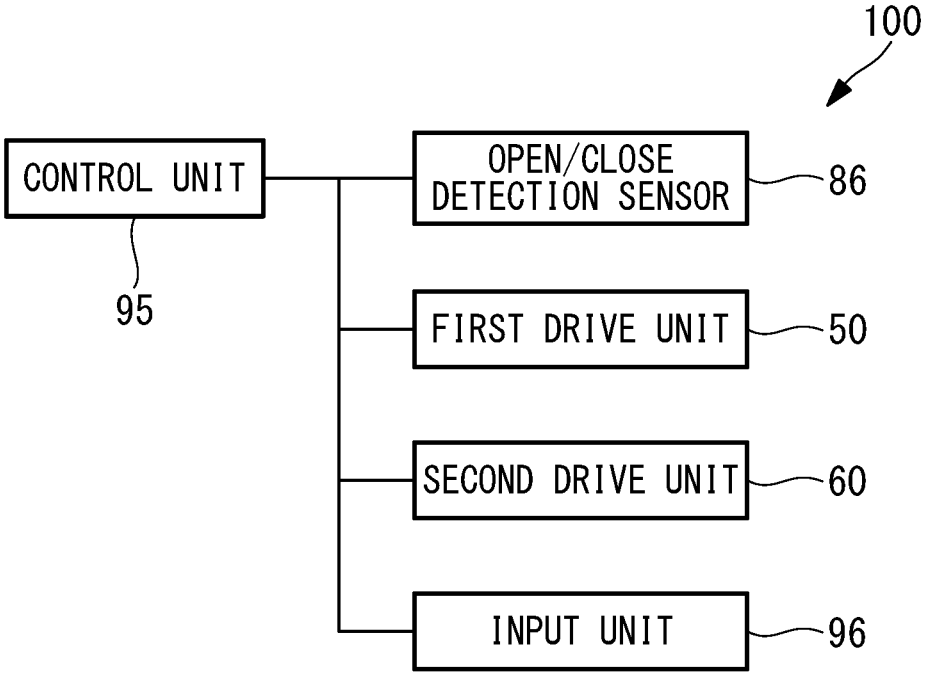
FIG. 3 is a block diagram illustrating a control configuration of the tube pump.

FIG. 3 is a block diagram illustrating a control configuration of the tube pump 100. As illustrated in FIG. 3, the tube pump 100 of the present embodiment includes a first drive unit 50 that rotates the first roller part 10 about the axis X1 in the rotation direction RD, a second drive unit 60 that rotates the second roller part 20 about the axis X1 in the rotation direction RD, a control unit 95 that controls the first drive unit 50 and the second drive unit 60, and an input unit 96 used for inputting an operation instruction for the tube pump 100 from the operator. The first drive unit 50 and the second drive unit 60 rotate the first roller part 10 and the second roller part 20, respectively, about the axis X1 in the same direction in the rotation direction RD.

The tube pump 100 of the present embodiment can implement an ejection control mode (first control mode) to rotate the first roller part 10 and the second roller part 20 in the same direction so as to perform ejection of a fluid contained inside the tube 200 by using the first roller part 10 and the second roller part 20 under the control of the control unit 95 on the first drive unit 50 and the second drive unit 60.

When implementing the ejection control mode, the operator sets a flow rate per unit time via the input unit 96 at which the tube pump 100 ejects a liquid to the outflow side 200*b*. The control unit 95 controls the first drive unit 50 and the second drive unit 60 so that a liquid at the set flow rate is ejected to the outflow side 200*b*.

Further, the tube pump 100 of the present embodiment can implement a tube replacement mode (second control mode) to fix respective rotation angles of the first roller part 10 and the second roller part 20 so that the first roller part 10 and the second roller part 20 are not in contact with the tube 200 under the control of the control unit 95 on the first drive unit 50 and the second drive unit 60.

When implementing the tube replacement mode, the operator provides an instruction to implement the tube replacement mode via the input unit 96. As illustrated in FIG. 2, when implementing the tube replacement mode, the control unit 95 fixes respective rotation angles of the first roller part 10 and the second roller part 20 so that the first roller part 10 and the second roller part 20 are not in contact with the tube 200.

Further, the tube pump 100 includes an open/close detection sensor 86 that detects whether the lid 85 described later is in an open state or a closed state. When the open/close detection sensor 86 detects that the lid 85 is in the open state and a signal indicating the open state is transmitted from the open/close detection sensor 86, the control unit 95 controls the first drive unit 50 and the second drive unit 60 to stop.

Figure 4:
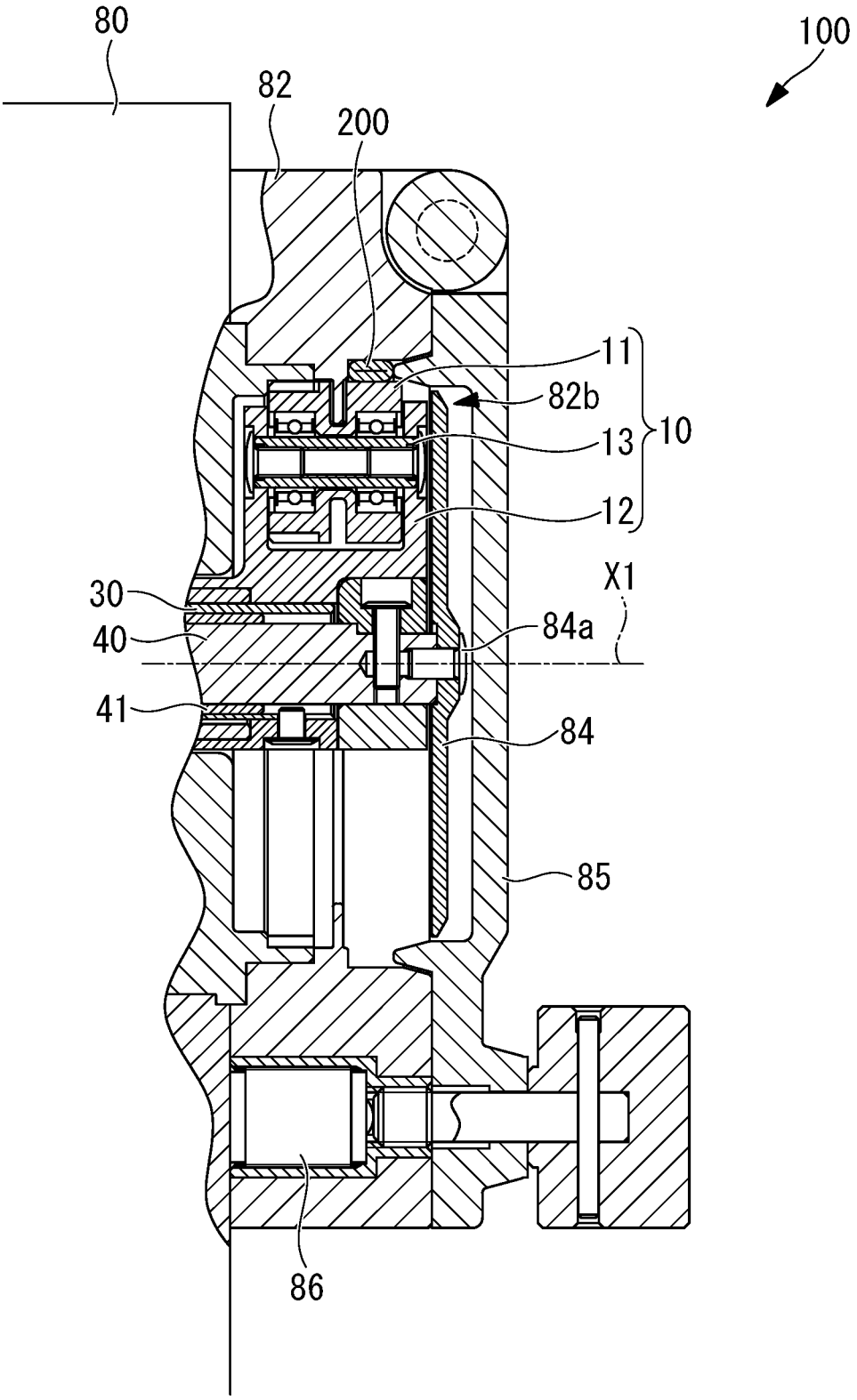
FIG. 4 is an arrow A-A longitudinal sectional view of the tube pump illustrated in FIG. 1.

FIG. 4 is an arrow A-A longitudinal sectional view of the tube pump 100 illustrated in FIG. 1. As illustrated in FIG. 4, the tube pump 100 of the present embodiment includes the first roller part 10 and the second roller part 20 rotated about the axis X1 with the tube 200 being blocked, a drive cylinder 30 connected to the first roller part 10, and a drive shaft 40 arranged on the axis X1 and connected to the second roller part 20. The first drive unit 50 transmits drive force from an electric motor (not illustrated; for example, a pulse motor) to the drive cylinder 30 to rotate the drive cylinder 30 about the axis X1. The second drive unit 60 transmits drive force from an electric motor (not illustrated; for example, a pulse motor) to the drive shaft 40 to rotate the drive shaft 40 about the axis X1.

The drive cylinder 30 is supported rotatably about the axis X1 on the outer circumferential side of the drive shaft 40 by a cylindrical bearing member 41 inserted along the inner circumference face. A first roller support member 12 of the first roller part 10 is connected to the tip side of the drive cylinder 30 so as to be integrally rotated about the axis X1. The drive force with which the first drive unit 50 rotates the drive cylinder 30 about the axis X1 is transmitted to the first roller part 10 via the first roller support member 12.

The drive shaft 40 is supported rotatably about the axis X1 on the inner circumferential side of the drive cylinder 30 by a cylindrical bearing member 41 inserted along the outer circumference face. The drive shaft 40 is rotated smoothly about the axis X1 with the central axis being held on the axis X1. A second roller support member 22 of the second roller part 20 is connected to the tip side of the drive shaft 40 so as to be integrally rotated about the axis X1. The drive force with which the second drive unit 60 rotates the drive shaft 40 about the axis X1 is transmitted to the second roller part 20 via the second roller support member 22.

As illustrated in FIG. 1 and FIG. 4, the first roller part 10 has a first roller 11 that is rotated about a first roller shaft 13 parallel to the axis X1 while being in contact with the tube 200, the first roller support member 12 connected to the drive cylinder 30 so as to be integrally rotated about the axis X1, and the first roller shaft 13 whose both ends are supported by the first roller support member 12 and that installs the first roller 11 rotatably thereto.

The first drive unit 50 rotates the first roller part 10 about the axis X1 in the counterclockwise rotation direction RD. The first roller support member 12 is connected to the first drive unit 50 and rotated counterclockwise about the axis X1 while supporting the first roller 11.

As illustrated in FIG. 1, the second roller part 20 has a second roller 21 that is rotated about a second roller shaft 23 parallel to the axis X1 while being in contact with the tube 200, the second roller support member 22 connected to the drive shaft 40 so as to be integrally rotated about the axis X1, and the second roller shaft 23 whose both ends are supported by the second roller support member 22 and that installs the second roller 21 rotatably thereto.

The second drive unit 60 rotates the second roller part 20 about the axis X1 in the counterclockwise rotation direction RD. The second roller support member 22 is connected to the second drive unit 60 and rotated counterclockwise about the axis X1 while supporting the second roller 21.

The first drive unit 50 and the second drive unit 60 are accommodated inside a casing 80 (accommodation member) illustrated in FIG. 4. The accommodation part 82 for accommodating the first roller part 10 and the second roller part 20 is installed to the end of the casing 80. The tube 200 is arranged along the inner circumferential face 82*a* of the accommodation part 82.

Figure 5:
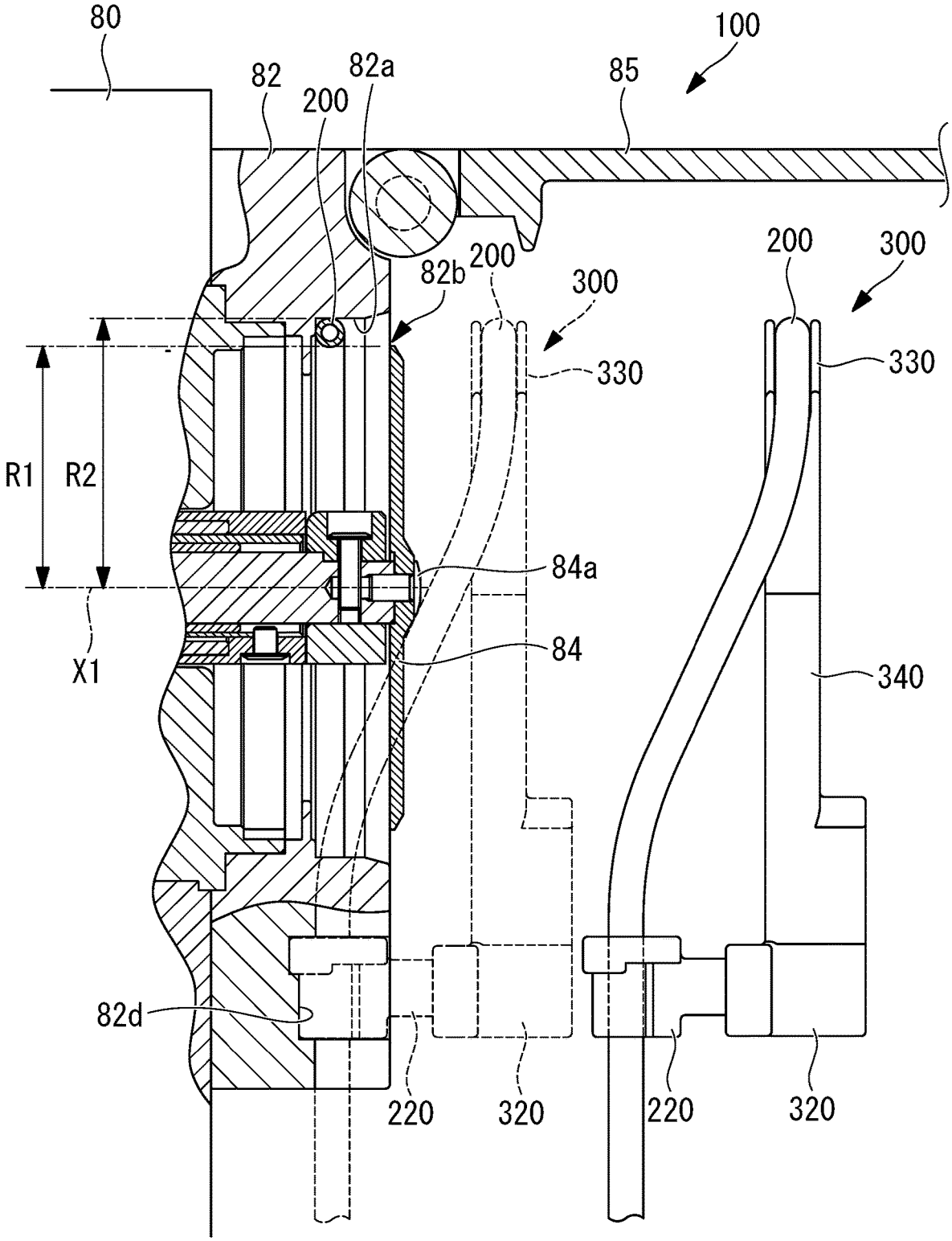
FIG. 5 is an arrow B-B sectional view of the tube pump illustrated in FIG. 2.

FIG. 5 is an arrow B-B sectional view of the tube pump illustrated in FIG. 2 and illustrates the lid 85 in the open state. As illustrated in FIG. 5, when installing the tube 200 to the accommodation part 82 of the tube pump 100 of the present embodiment, the operator installs the tube 200 to the tube holding device 300 via the first tube holding member 210 and the second tube holding member 220 and then moves the tube holding device 300 to the position indicated by solid lines in FIG. 5.

The operator then moves the tube holding device 300 to the position indicated by dotted lines in FIG. 5 so as to insert the first tube holding member 210 into the first insertion groove 82*c* and insert the second tube holding member 220 into the second insertion groove 82*d*. The operator then detaches the tube 200 from the tube holding device 300 and inserts the tube 200 into the recess 82*b* of the accommodation part 82.

As illustrated in FIG. 4 and FIG. 5, the tube pump 100 of the present embodiment includes the cover member 84 arranged in the recess 82*b* of the accommodation part 82 and the lid 85 whose open/close state can be switched. The lid 85 is a member that can be switched between a close state (the state indicated by the solid lines) where the lid 85 covers the entire region (the region of the radius R2 centered on the axis X1) of the recess 82*b* of the accommodation part 82 and an open state (the state indicated by the dotted lines) where the lid 85 is separated from the recess 82*b*.

The cover member 84 is a member for preventing the operator from touching a part near the first roller part 10 and the second roller part 20 by its hand when the lid 85 is in the open state and preventing the operator's finger from being caught between the first roller part 10 and the second roller part 20. Since the first roller part 10 and the second roller part 20 of the present embodiment are rotatable about the axis X1, respectively, independently, the rotation angle (angle θ in FIG. 1) about the axis X1 between the first roller part 10 and the second roller part 20 changes from a wider state to a narrower state. Accordingly, the present embodiment provides the cover member 84 and thereby prevents a failure of the operator's finger being caught.

The cover member 84 is provided so as to cover the first roller part 10 and the second roller part 20 and fastened to the drive shaft 40 by the fastening screw 84*a*. The cover member 84 is a member whose shape formed in planar view is a circle having a radius R1 centered on the axis X1 passing through the center of the drive shaft 40. In FIG. 5, the arc-shaped inner circumferential face 82*a* on which the tube 200 is arranged is a surface arranged along the circle having the radius R2 centered on the axis X1.

As illustrated in FIG. 2, the region from the radius R1 to the radius R2 centered on the axis X1 is an annular opening region OA. The tube 200 in the natural state at a position where the first roller part 10 and the second roller part 20 are not in contact with the tube 200 has an outer diameter D1. The outer diameter D1 is smaller than the difference of the radius R2 minus the radius R1. Thus, the opening region OA allows the tube 200 to be inserted toward the inner circumferential face 82*a*.

As illustrated in FIG. 1, FIG. 2, and FIG. 4, the tube pump 100 of the present embodiment includes the open/close detection sensor (detection unit) 86 that detects the open/close state of the lid 85. The open/close detection sensor 86 is in an ON state when the lid 85 is arranged at a close position and is in an OFF state when the lid 85 is arranged at a distant position.

Since the operator moves the lid 85 into the open state when replacing the tube 200 or the like, the operator's finger could be caught between the first roller part 10 and the second roller part 20 if the first drive unit 50 and the second drive unit 60 remain in operation. In the present embodiment, since the first drive unit 50 and the second drive unit 60 are stopped when the lid 85 is in the open state, it is possible to prevent a failure of the operator's finger being caught between the first roller part 10 and the second roller part 20.

Note that the tube pump 100 of the present embodiment includes the cover member 84 arranged over the recess 82*b* so as to cover the first roller part 10 and the second roller part 20. Thus, even when the first roller part 10 and the second roller part 20 have not yet stopped immediately after the lid 85 has been turned from the close state to the open state or even when some malfunction has occurred, it is possible to prevent a failure of the operator's finger being caught between the first roller part 10 and the second roller part 20.

Figure 6:
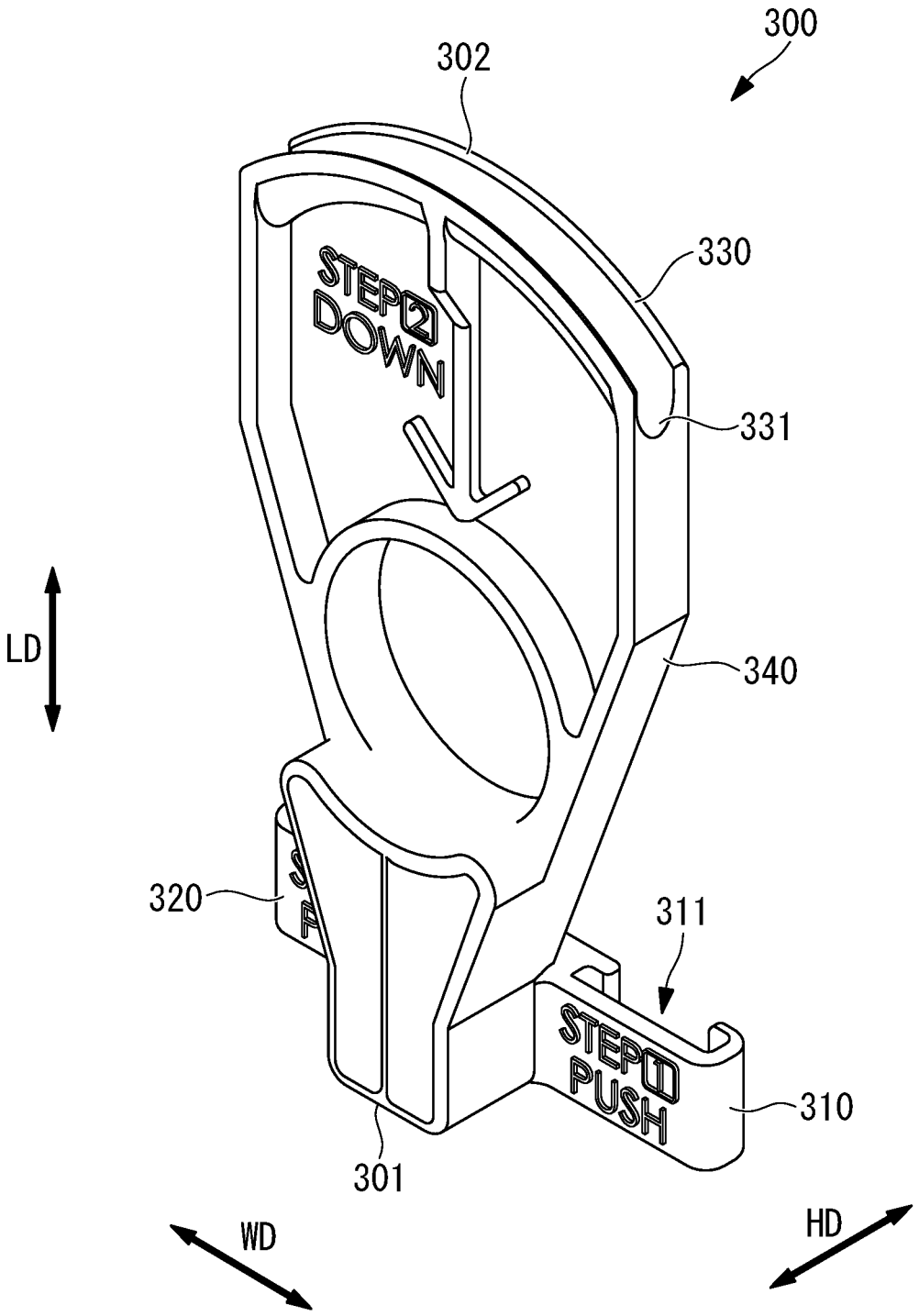
FIG. 6 is a perspective view illustrating a tube holding device.
Figure 7:
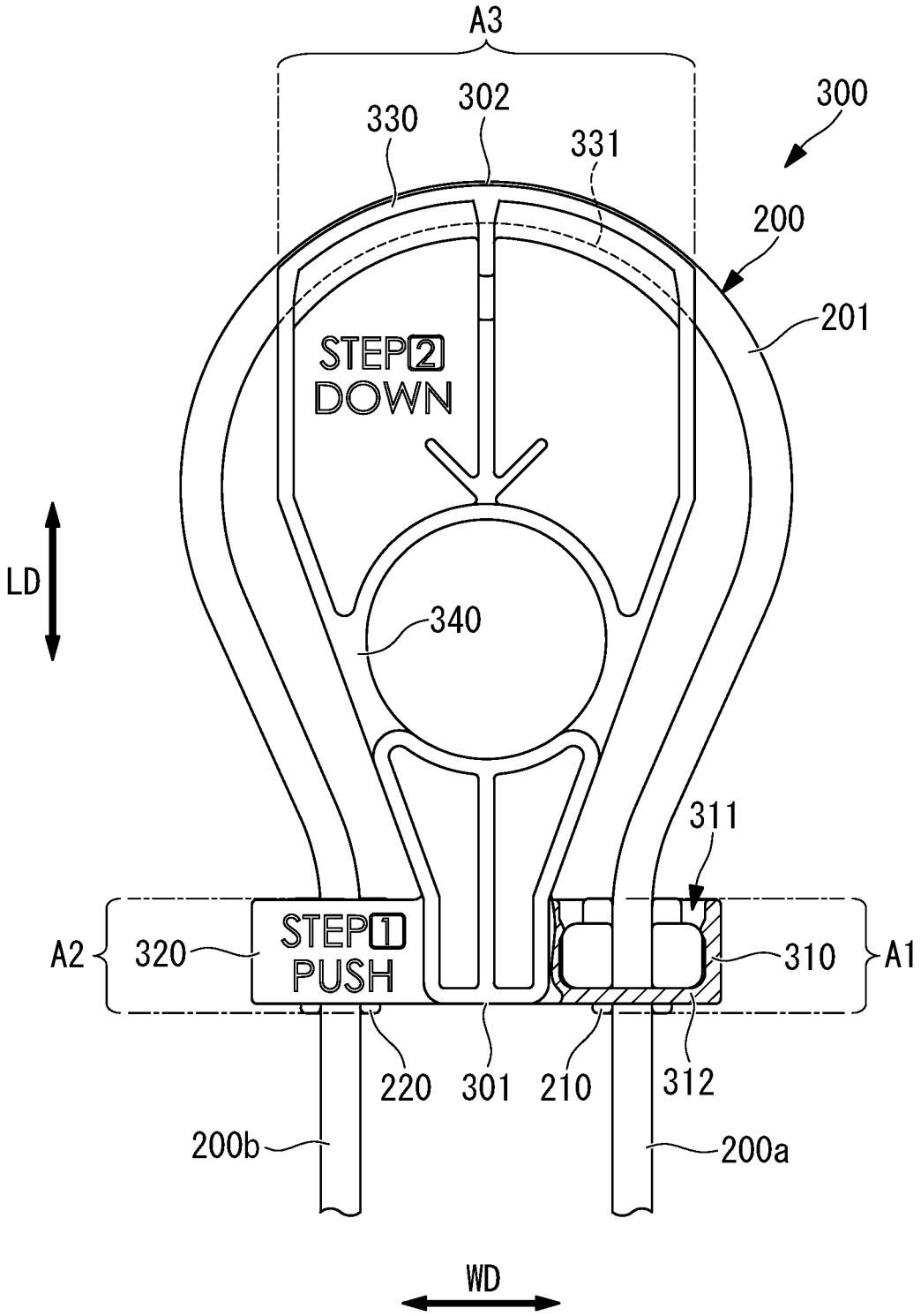
FIG. 7 is a plan view of the tube holding device illustrated in FIG. 6.
Figure 8:
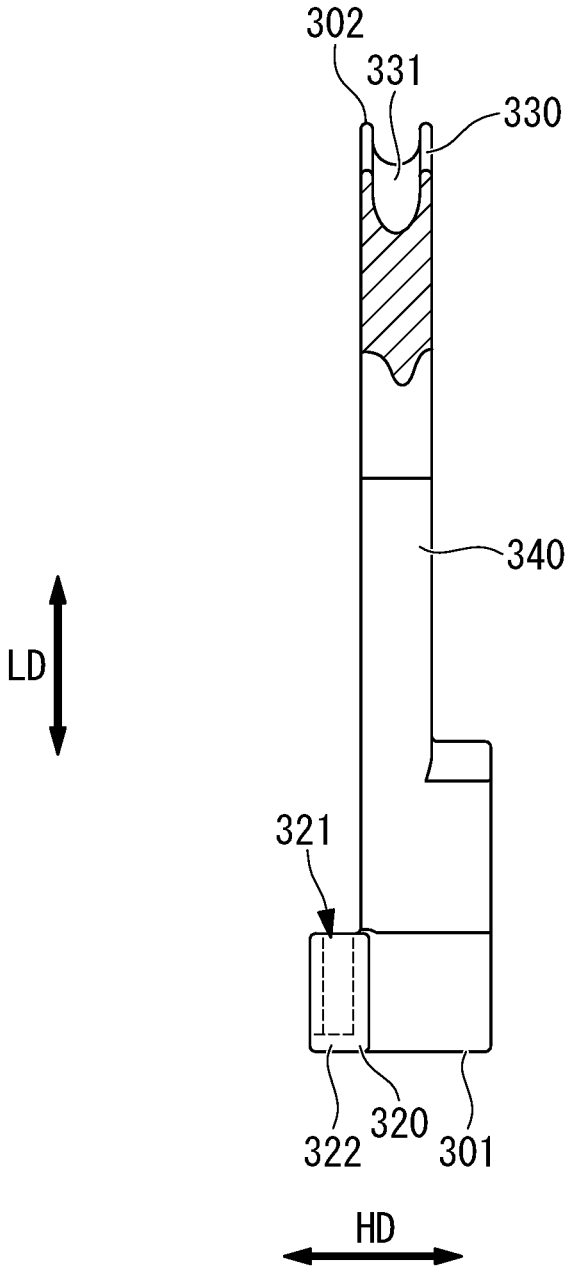
FIG. 8 is a left side view of the tube holding device illustrated in FIG. 6.
Figure 9:
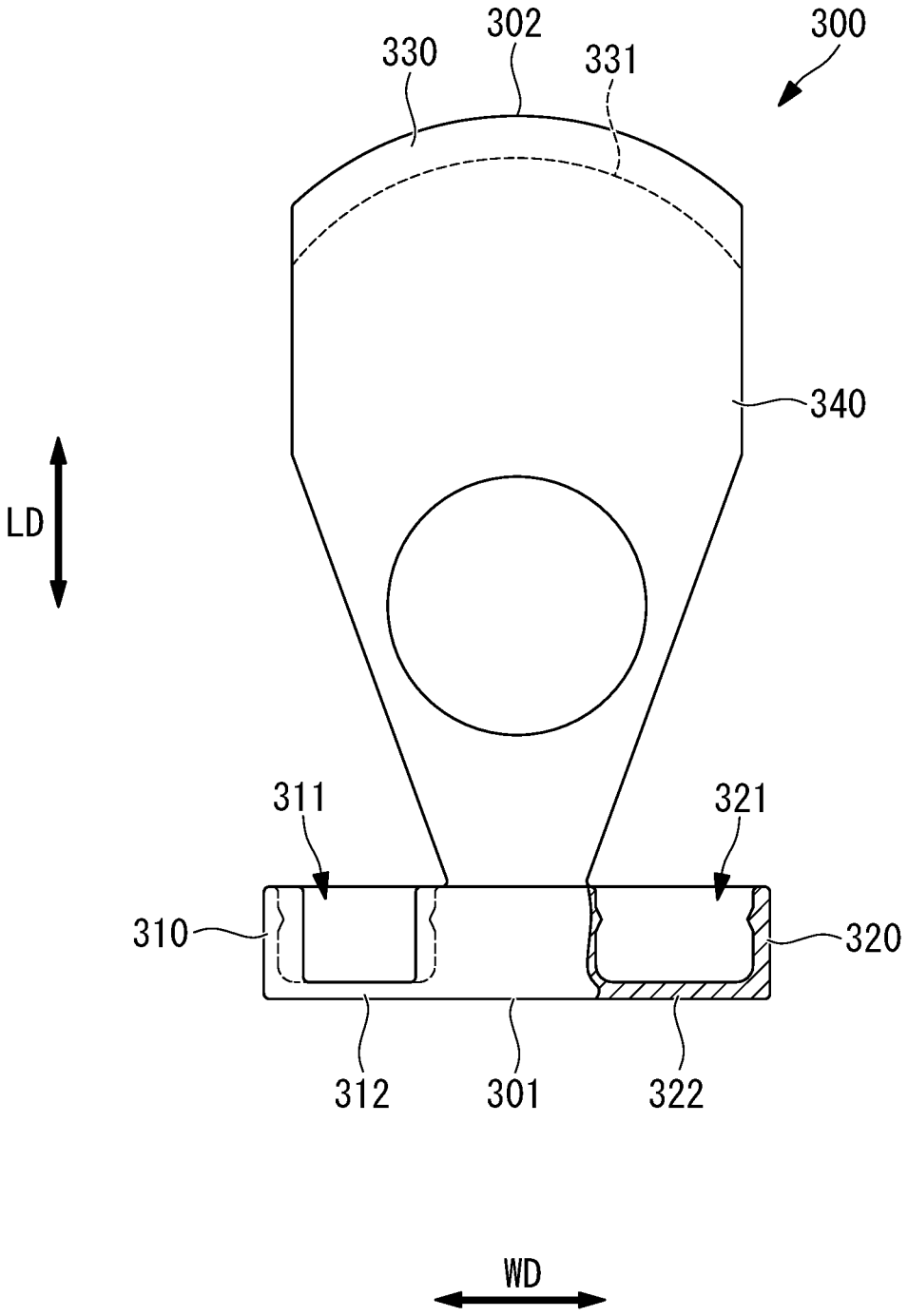
FIG. 9 is a bottom view of the tube holding device illustrated in FIG. 6.

Next, the tube holding device 300 of the present embodiment will be described with reference to the drawings. FIG. 6 is a perspective view illustrating the tube holding device 300. FIG. 7 is a plan view of the tube holding device 300 illustrated in FIG. 6. FIG. 8 is a left side view of the tube holding device 300 illustrated in FIG. 6. FIG. 9 is a bottom view of the tube holding device 300 illustrated in FIG. 6.

The tube holding device 300 is a device that holds the tube 200 to be installed to the tube pump 100 in a predetermined shape so as not to cause deformation such as twisting. As illustrated in FIG. 6 to FIG. 9, the tube holding device 300 includes a first installation part 310, a second installation part 320, a support part 330, and a main body 340.

As illustrated in FIG. 7, the first installation part 310 is a portion to which the first tube holding member 210 that holds the first region A1 of the tube 200 is detachably installed. The second installation part 320 is a portion to which the second tube holding member 220 that holds the second region A2 of the tube 200 is detachably installed. The first installation part 310 and the second installation part 320 are arranged apart from each other in the width direction WD orthogonal to the longitudinal direction LD. The first installation part 310 and the second installation part 320 install the first tube holding member 210 and the second tube holding member 220 so that the spacing in the width direction WD between the first tube holding member 210 and the second tube holding member 220 matches the spacing in the width direction WD between the first insertion groove 82*c* and the second insertion groove 82*d*.

As illustrated in FIG. 7 and FIG. 9, the first installation part 310 has a first insertion hole 311 and a first wall part 312. The first insertion hole 311 is a hole into which the first tube holding member 210 can be inserted from the other end 302 side to one end 301 side in the longitudinal direction LD. The first wall part 312 is a portion that inhibits the first tube holding member 210 inserted in the first insertion hole 311 from moving from the other end 302 side to the one end 301 side.

The second installation part 320 has a second insertion hole 321 and a second wall part 322. The second insertion hole 321 is a hole into which the second tube holding member 220 can be inserted from the other end 302 side to the one end 301 side in the longitudinal direction LD. The second wall part 322 is a portion that inhibits the second tube holding member 220 inserted in the second insertion hole 321 from moving from the other end 302 side to the one end 301 side.

The support part 330 is a portion that supports a part of the outer circumferential face 201 of the tube 200 in a third region A3 between the first region A1 and the second region A2 of the tube 200 with the first tube holding member 210 being installed to the first installation part 310 and the second tube holding member 220 being installed to the second installation part 320.

As illustrated in FIG. 8, the support part 330 has a support face 331 that is substantially semicircular (or is semicircular) in sectional view. The support part 330 is arranged at a position offset from the first installation part 310 and the second installation part 320 in the height direction HD orthogonal to the longitudinal direction LD and the width direction WD.

The main body 340 is a portion where the first installation part 310, the second installation part 320, and the support part 330 are connected thereto, respectively. The first installation part 310, the second installation part 320, the support part 330, and the main body 340 are integrally formed of a resin material (for example, a thermoplastic resin material such as polycarbonate, polypropylene, ABS, or the like).

As illustrated in FIG. 6 to FIG. 9, the first installation part 310 and the second installation part 320 are arranged on the one end 301 side in the longitudinal direction LD of the tube holding device 300, and the support part 330 is arranged on the other end side in the longitudinal direction LD. The support part 330 is arranged such that the support face 331 faces the other end side in the longitudinal direction LD.

Figure 10:
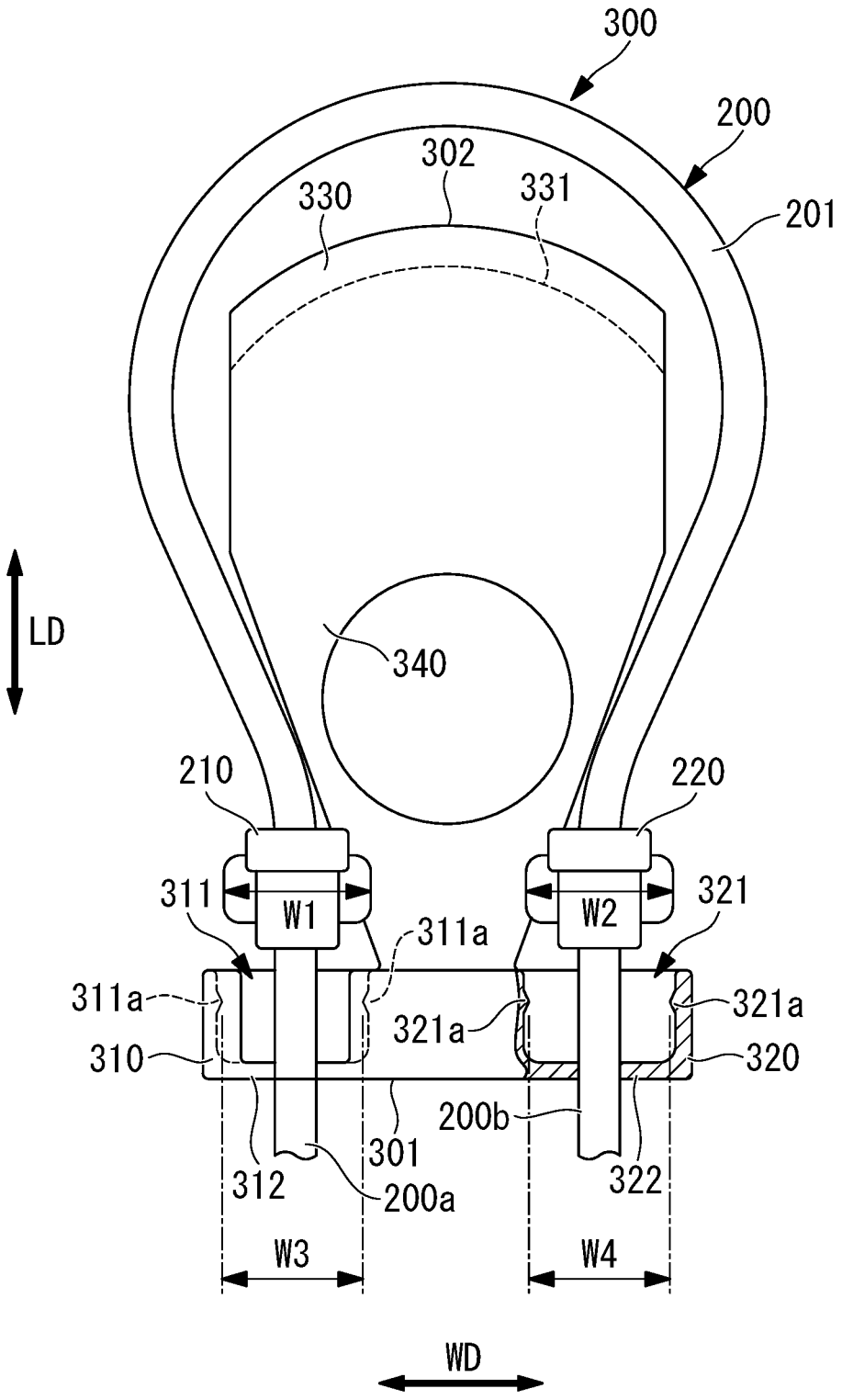
FIG. 10 is a diagram illustrating a state before a first tube holding member and a second tube holding member are installed to the tube holding device illustrated in FIG. 9.
Figure 11:
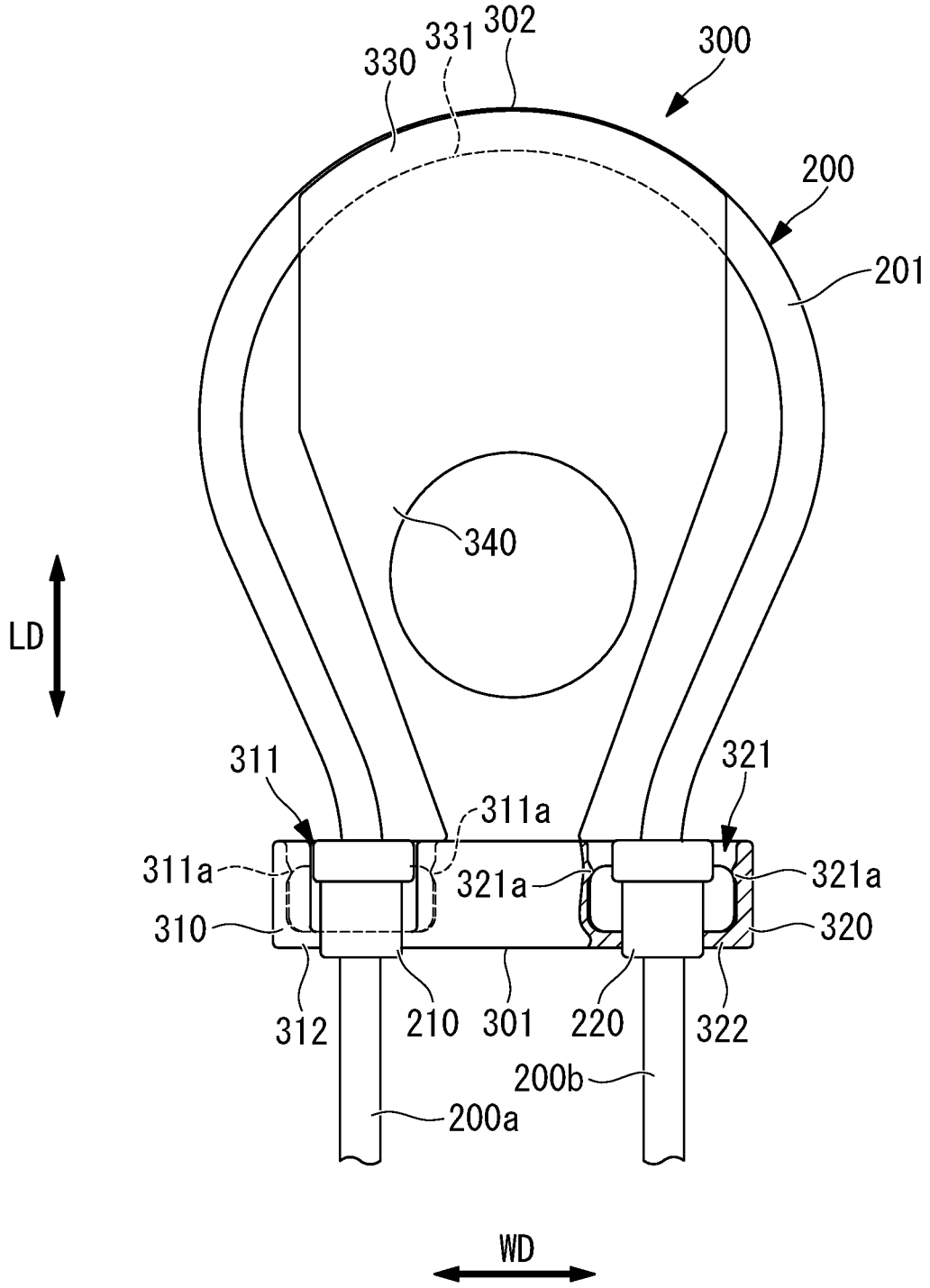
FIG. 11 is a diagram illustrating a state where the first tube holding member and the second tube holding member have been installed to the tube holding device illustrated in FIG. 9.

Next, the operation to install the tube 200 to the tube holding device 300 will be described with reference to FIG. 10 and FIG. 11. FIG. 10 is a diagram illustrating a state before the first tube holding member 210 and the second tube holding member 220 are installed to the tube holding device 300 illustrated in FIG. 9. FIG. 11 is a diagram illustrating a state where the first tube holding member 210 and the second tube holding member 220 have been installed to the tube holding device 300 illustrated in FIG. 9.

As illustrated in FIG. 10, the length in the width direction WD of the first tube holding member 210 is W1, and the length in the width direction WD of the second tube holding member 220 is W2. A pair of protrusions 311*a* are formed in the first insertion hole 311 of the first installation part 310. The spacing in the width direction WD of the pair of protrusions 311*a* is W3. A pair of protrusions 321*a* are formed in the second insertion hole 321 of the second installation part 320. The spacing in the width direction WD of the pair of protrusions 321*a* is W4.

As illustrated in FIG. 10, W1 is larger than W3, and W2 is larger than W4. Thus, when the first tube holding member 210 is inserted in the first insertion hole 311, the first tube holding member 210 abuts against the pair of protrusions 311*a* and elastically deforms the first installation part 310, which results in the state illustrated in FIG. 11. Further, when the second tube holding member 220 is inserted in the second insertion hole 321, the second tube holding member 220 abuts against the pair of protrusions 321*a* and elastically deforms the second installation part 320, which results in the state illustrated in FIG. 11.

As illustrated in FIG. 11, once the first tube holding member 210 is inserted in the first insertion hole 311 and reaches a position in contact with the first wall part 312, this leads to a state where the first tube holding member 210 is supported so as not to come out of the first insertion hole 311 due to the pair of protrusions 311*a*. Similarly, once the second tube holding member 220 is inserted in the second insertion hole 321 and reaches a position in contact with the second wall part 322, this leads to a state where the second tube holding member 220 is supported so as not to come out of the second insertion hole 321 due to the pair of protrusions 321*a*.

Figure 12:
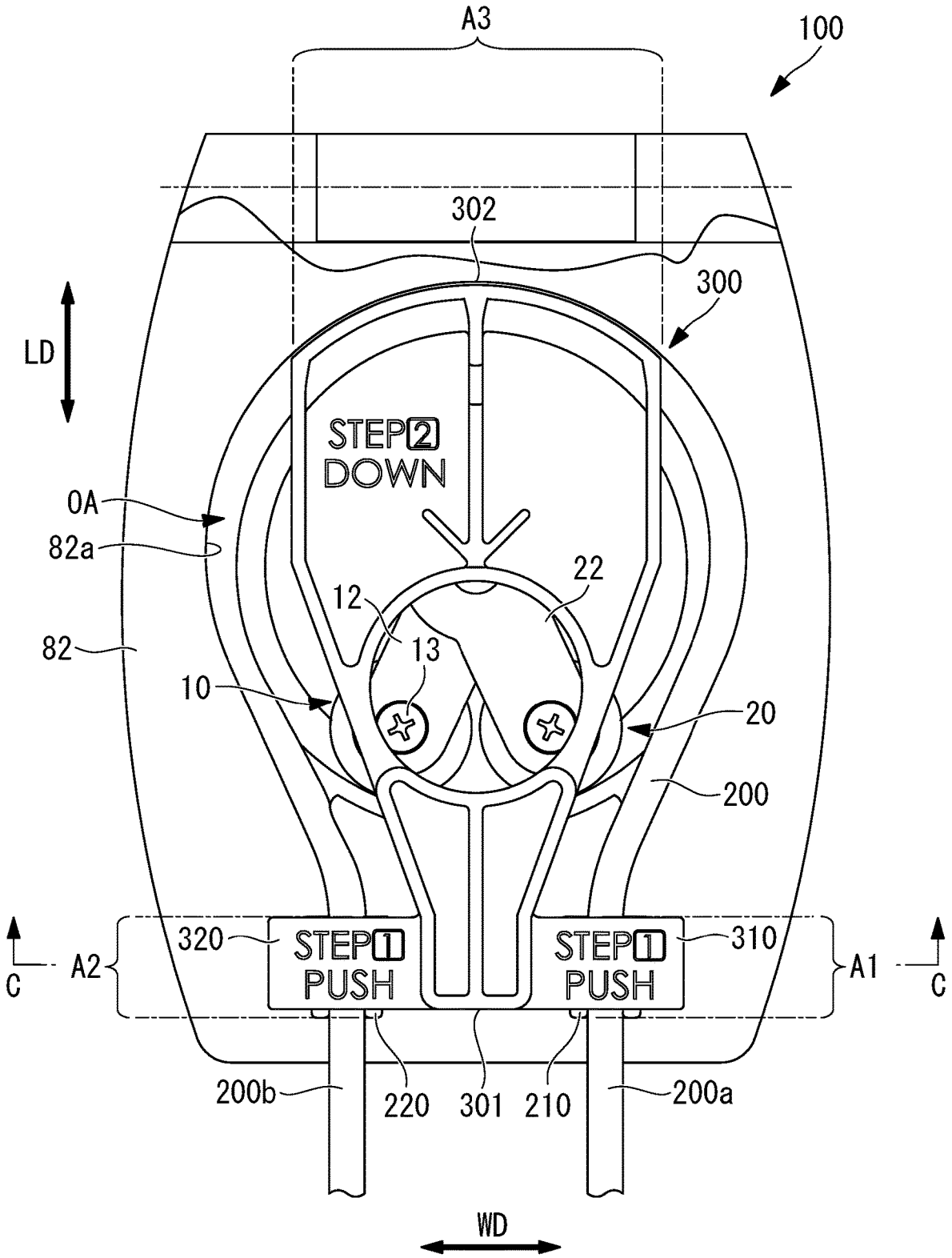
FIG. 12 is a plan view illustrating a state where the tube held by the tube holding device has been installed to the tube pump in a tube replacement mode.
Figure 13:
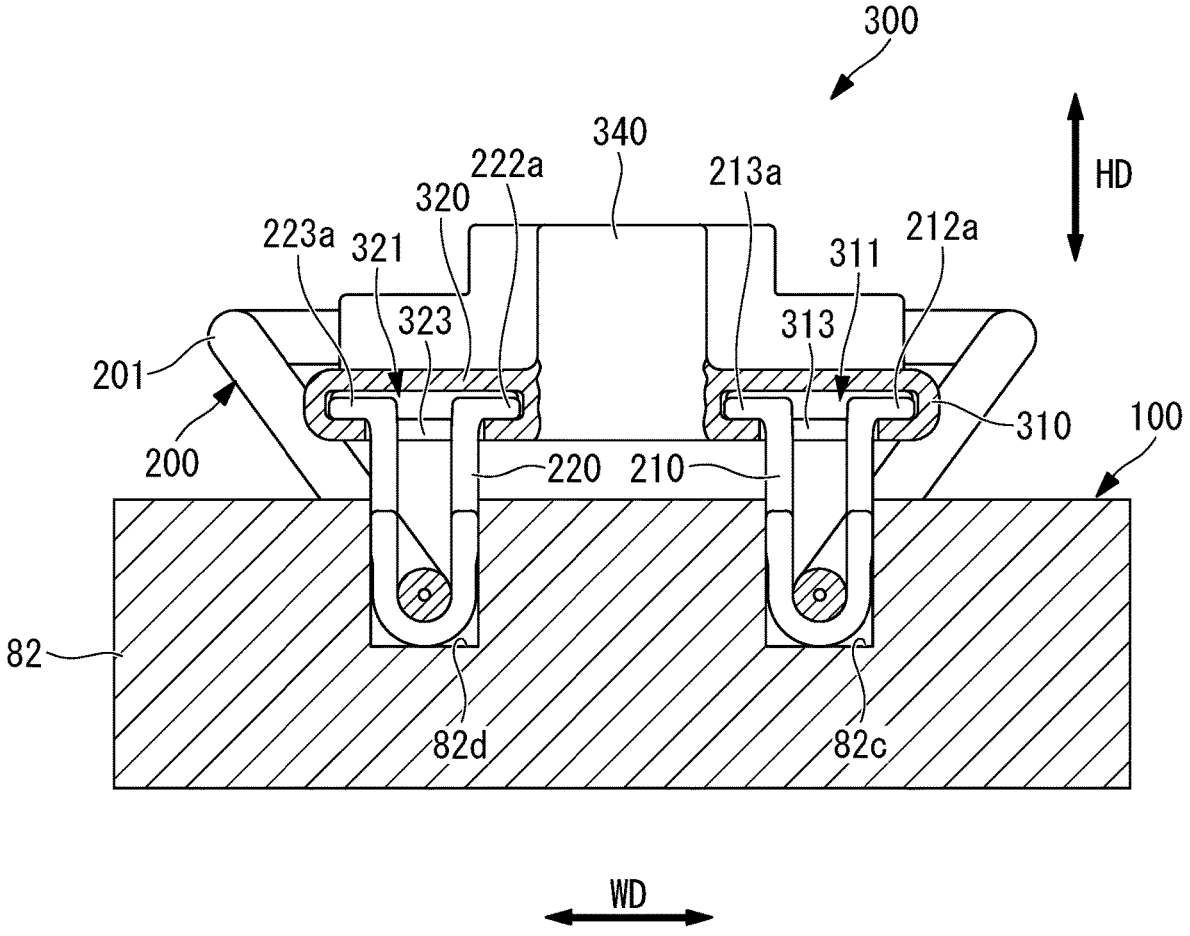
FIG. 13 is an arrow C-C sectional view of the tube pump and the tube holding device illustrated in FIG. 12.

FIG. 12 is a plan view illustrating a state where the tube 200 held by the tube holding device 300 has been installed to the tube pump 100 in the tube replacement mode. FIG. 13 is an arrow C-C sectional view of the tube pump 100 and the tube holding device 300 illustrated in FIG. 12. The operator may insert the first tube holding member 210 installed to the first installation part 310 into the first insertion groove 82*c* and insert the second tube holding member 220 installed to the second installation part 320 into the second insertion groove 82*d*, which results in the state illustrated in FIG. 12 and FIG. 13.

Next, the structure of the first tube holding member 210 will be described with reference to FIG. 14. Note that, since the structure of the second tube holding member 220 is the same as the structure of the first tube holding member 210, the description thereof will be omitted in the following.

Figure 14:
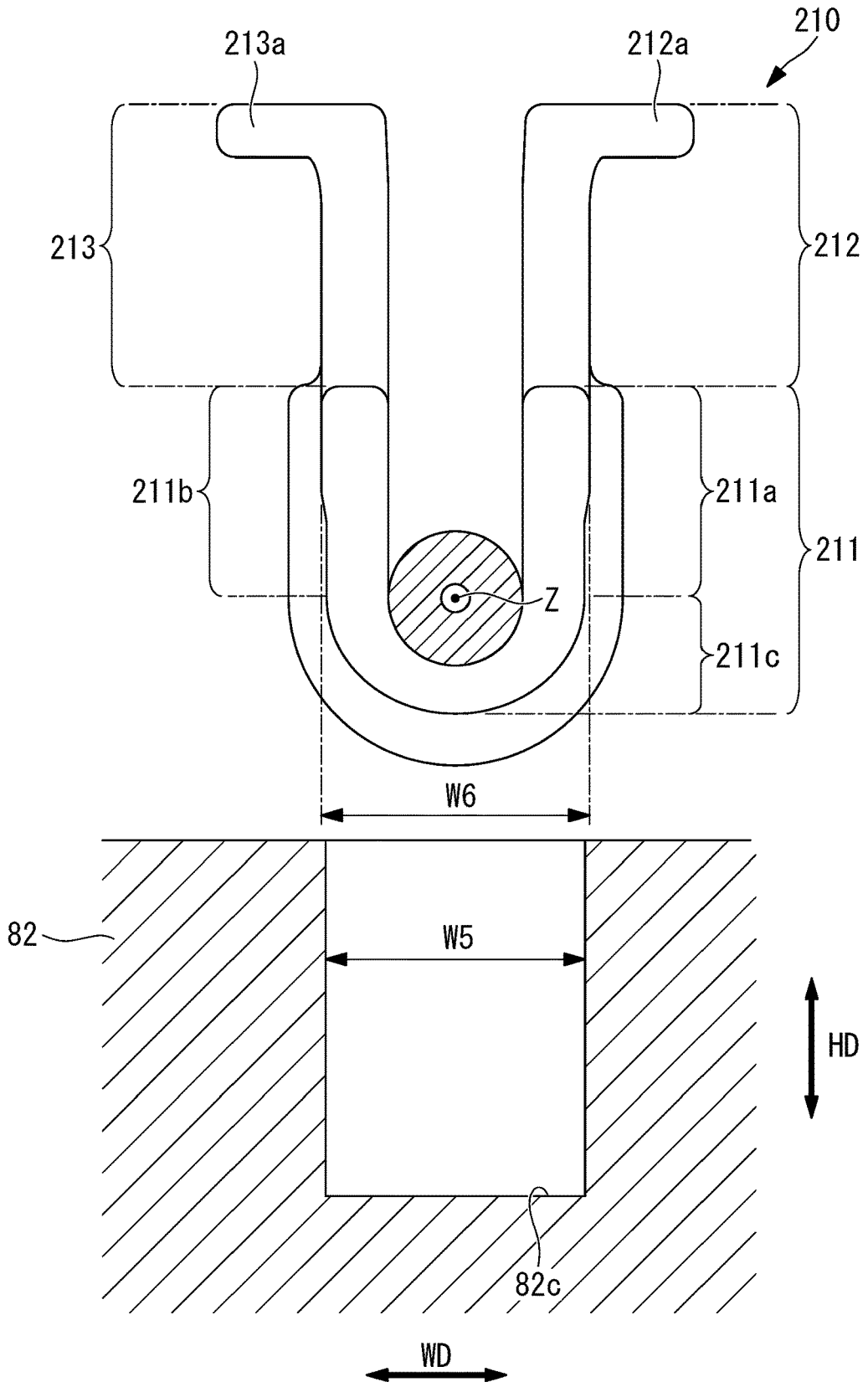
FIG. 14 is a partial enlarged view of the first tube holding member illustrated in FIG. 13 and illustrates a state before the first tube holding member is inserted in a first insertion groove.

FIG. 14 is a partial enlarged view of the first tube holding member 210 illustrated in FIG. 13 and illustrates a state before the first tube holding member 210 is inserted in the first insertion groove 82*c*. As illustrated in FIG. 14, the first tube holding member 210 includes an insertion part 211, an arm part 212, and an arm part 213. The insertion part 211, the arm part 212, and the arm part 213 are integrally molded of an elastically deformable flexible resin material (for example, polycarbonate). The first tube holding member 210 holds the tube 200 extending along the axis Z.

A protruding part 212*a* protruding outward in the width direction WD is formed at the top end in the height direction HD of the arm part 212. Similarly, a protruding part 213*a* protruding outward in the width direction WD is formed at the top end in the height direction HD of the arm part 213. As illustrated in FIG. 13, the protruding part 212*a* and the protruding part 213*a* are portions to be inserted in the first insertion hole 311 of the first installation part 310 of the tube holding device 300.

A slit 313 whose length in the width direction WD is smaller than the first tube holding member 210 is formed in the first installation part 310. A portion except for the protruding part 212*a* and the protruding part 213*a* of the first tube holding member 210 is arranged below the slit 313. Further, a slit 323 whose length in the width direction WD is smaller than the second tube holding member 220 is formed also in the second installation part 320 of the tube holding device 300. A portion except for the protruding part 222*a* and the protruding part 223*a* of the second tube holding member 220 is arranged below the slit 323.

The insertion part 211 is a portion to be inserted in the first insertion groove 82*c*. The arm part 212 and the arm part 213 are portions extending in the height direction HD and, with the insertion part 211 being inserted in the first insertion groove 82*c*, protruding upward in the height direction HD from the first insertion groove 82*c*.

The insertion part 211 has a wall part 211*a*, a wall part 211*b*, and a connecting part 211*c*. The wall part 211*a* is a portion to be connected to the arm part 212. The wall part 211*b* is a portion to be connected to the arm part 213. The wall part 211*a* and the wall part 211*b* are arranged apart from each other in the width direction WD so as to maintain the tube 200 interposed therebetween.

The connecting part 211*c* is a member connected between the wall part 211*a* and the wall part 211*b*. The connecting part 211*c* is arranged facing the bottom of the first insertion groove 82*c* with the insertion part 211 being inserted in the first insertion groove 82*c*. The connecting part 211*c* is formed of a resin material and thus is a portion that can be elastically deformed so as to contract in the width direction WD when the operator pinches the arm part 212 and the arm part 213 by its fingers to reduce the spacing in the width direction WD between these arm parts.

As illustrated in FIG. 14, the wall part 211*a* and the wall part 211*b* have a width W6 that is larger than a width W5 of the first insertion groove 82*c* in the width direction WD without the insertion part 211 being inserted in the first insertion groove 82*c*. The wall part 211*a* and the wall part 211*b* are arranged in contact with the first insertion groove 82*c* so as to have the width W5 in the width direction WD with the insertion part 211 being inserted in the first insertion groove 82*c*. The operator may pinch the arm part 212 and the arm part 213 by its fingers, reduce the spacing between the wall part 211*a* and the wall part 211*b* to a spacing shorter than the width W6 in the width direction WD, and insert the first tube holding member 210 into the first insertion groove 82*c*.

Figure 15:
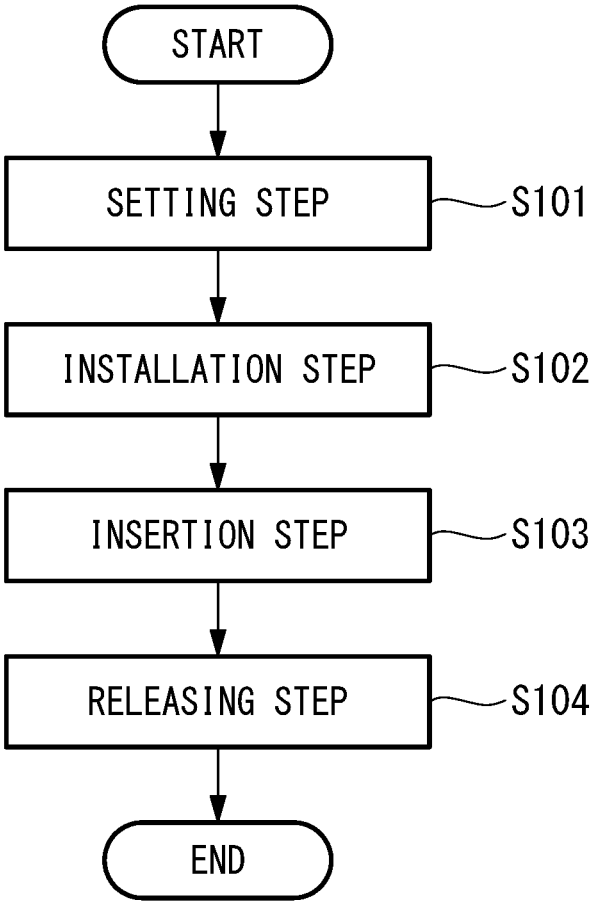
FIG. 15 is a flowchart illustrating a tube installation method for installing a tube to the tube pump.

Next, the tube installation method for installing the tube 200 to the tube pump 100 by using the tube holding device 300 of the present embodiment will be described. FIG. 15 is a flowchart illustrating the tube installation method for installing the tube 200 to the tube pump 100.

In step S101 (setting step), the operator uses a tube set jig 400 to set the first tube holding member 210 to the first region A1 of the tube 200 and set the second tube holding member 220 to the second region A2 of the tube 200.

Figure 16:
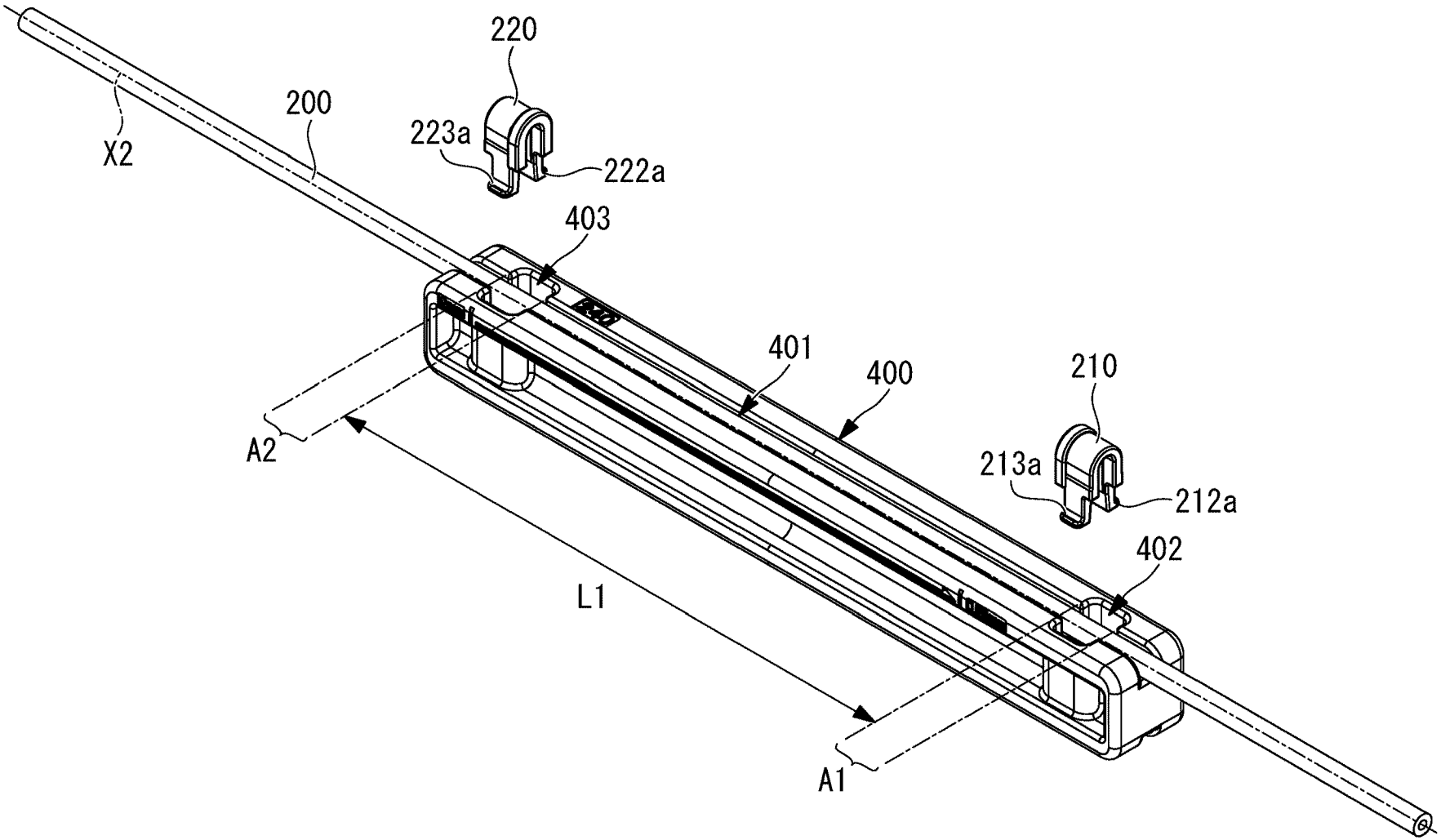
FIG. 16 is a perspective view illustrating a state where the tube has been installed in a tube set jig.

FIG. 16 is a perspective view illustrating a state where the tube 200 has been installed to the tube set jig 400. As illustrated in FIG. 16, the tube set jig 400 is a jig in which a groove 401 extending along the axis X2, an installation hole 402 to which the first tube holding member 210 is installed, and an installation hole 403 to which the second tube holding member 220 is installed are formed. The installation hole 402 and the installation hole 403 are arranged so that the distance along the axis X2 between the first region A1 and the second region A2 of the tube 200 is L1.

Figure 17:
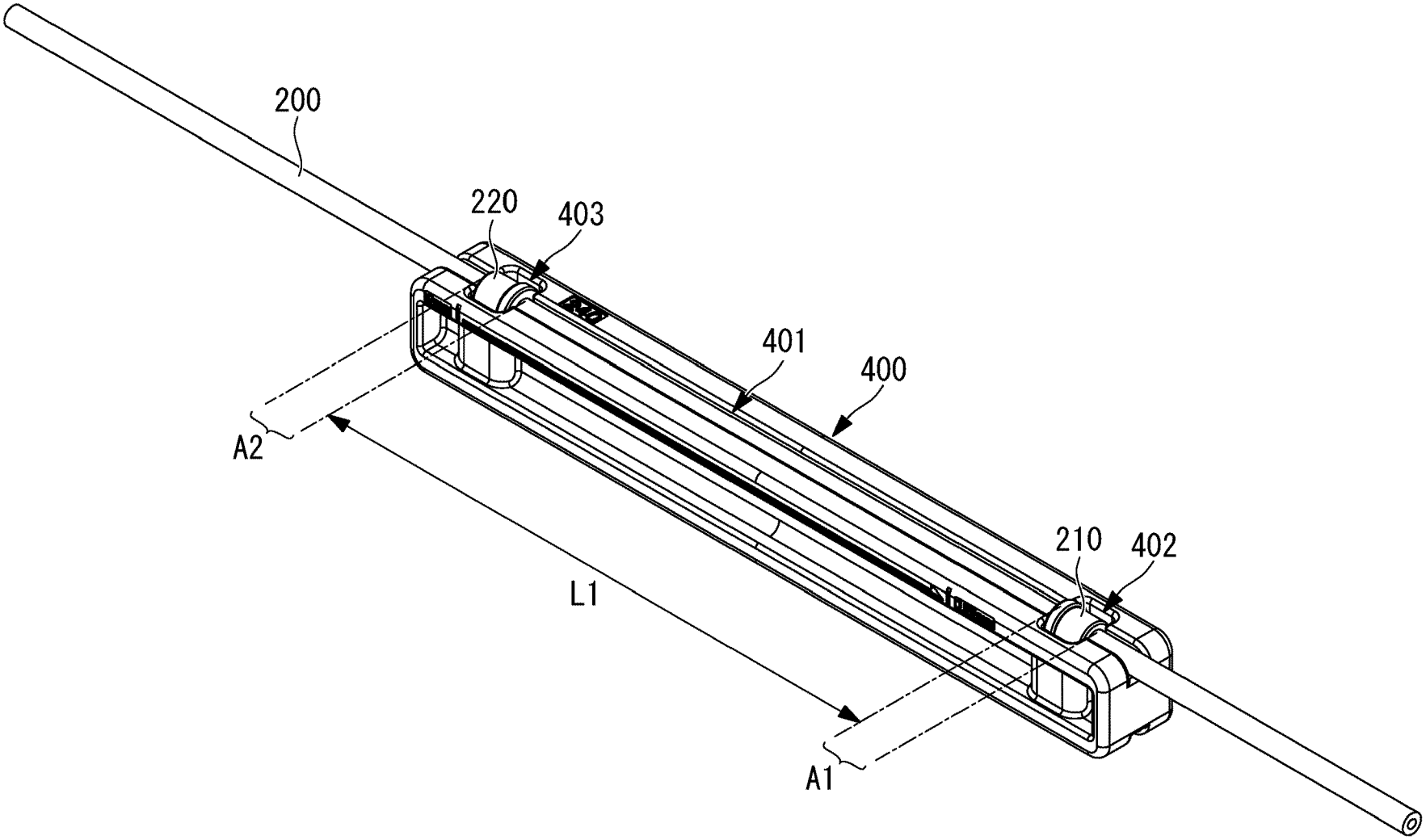
FIG. 17 is a perspective view illustrating a state where the first tube holding member and the second tube holding member have been installed to the tube.

The operator inserts the protruding part 212*a* and the protruding part 213*a* of the first tube holding member 210 into the installation hole 402 in the state illustrated in FIG. 16 and installs the first tube holding member 210 to the first region A1 of the tube 200. Further, the operator inserts the protruding part 222*a* and the protruding part 223*a* of the second tube holding member 220 into the installation hole 403 in the state illustrated in FIG. 16 and installs the second tube holding member 220 to the second region A2 of the tube 200, which results in a state illustrated in FIG. 17. FIG. 17 is a perspective view illustrating a state where the first tube holding member 210 and the second tube holding member 220 are installed to the tube 200.

Figure 18:
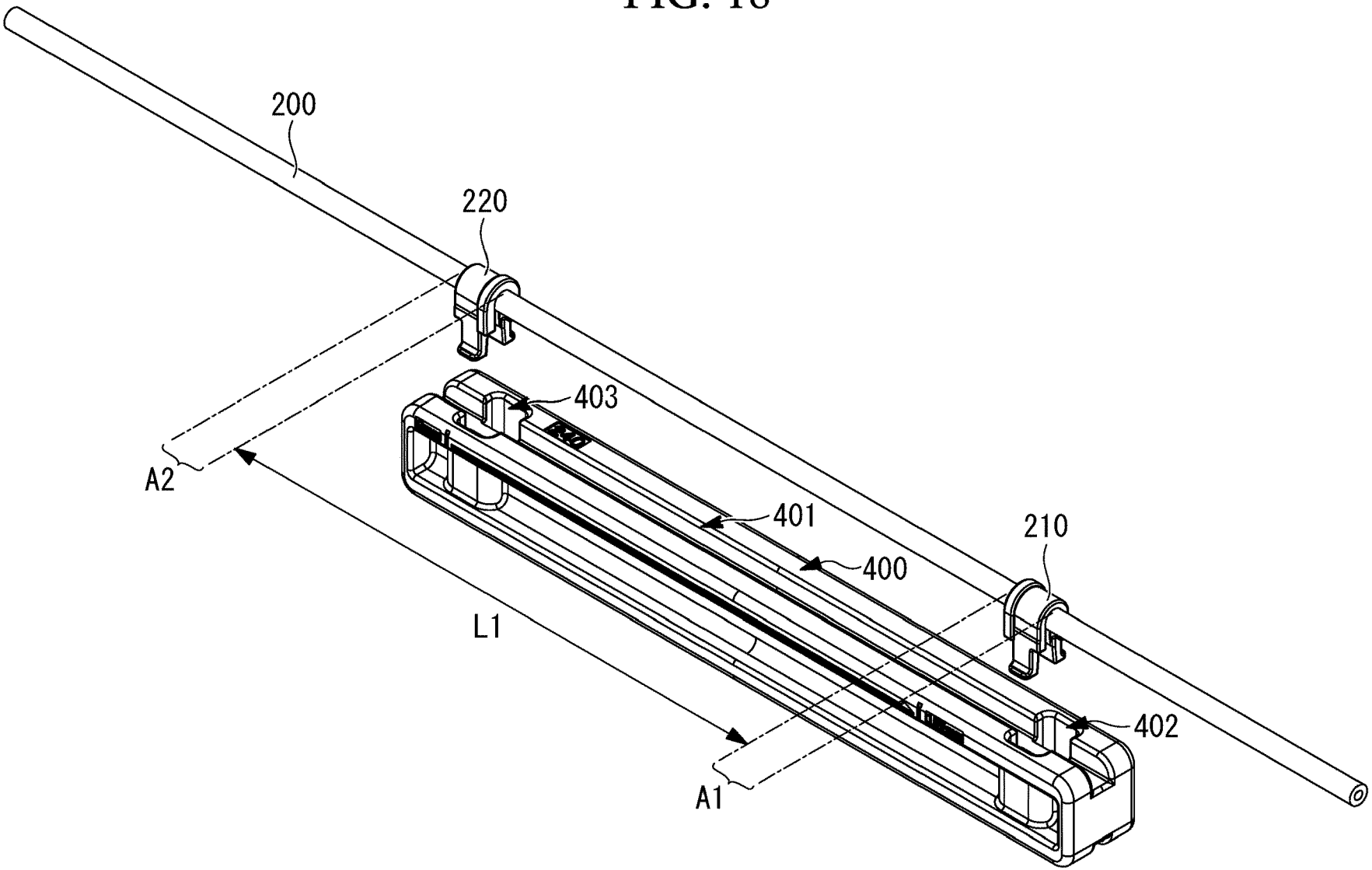
FIG. 18 is a perspective view illustrating a state where the tube has been detached from the tube set jig.

In the state illustrated in FIG. 17, the operator detaches, from the groove 401, the tube 200 to which the first tube holding member 210 and the second tube holding member 220 have been installed, which results in a state illustrated in FIG. 18. FIG. 18 is a perspective view illustrating a state where the tube 200 is detached from the tube set jig 400. As illustrated in FIG. 18, with the use of the tube set jig 400, it is possible to obtain the state where the first tube holding member 210 has been installed to the first region A1 of the tube 200 and the second tube holding member 220 has been installed to the second region A2 of the tube 200.

In step S102 (installation step), the operator installs the first tube holding member 210 to the first installation part 310 and installs the second tube holding member 220 to the second installation part 320 so that an insertion operation to insert the first tube holding member 210 installed to the first installation part 310 of the tube holding device 300 into the first insertion groove 82*c* and an insertion operation to insert the second tube holding member 220 installed to the second installation part 320 into the second insertion groove 82*d* can be performed at the same time. The operator installs the first tube holding member 210 and the second tube holding member 220 to the tube holding device 300 so that the state illustrated in FIG. 10 transitions to the state illustrated in FIG. 11.

In step S103 (insertion step), the operator moves the tube holding device 300 from the position indicated by the solid lines in FIG. 5 to the position indicated by the dotted lines, inserts the first tube holding member 210 installed to the first installation part 310 into the first insertion groove 82*c*, and inserts the second tube holding member 220 installed to the second installation part 320 into the second insertion groove 82*d*.

In the first installation part 310, the word "STEP(1) PUSH" indicating an operation of pushing the first installation part 310 against the first insertion groove 82*c* is displayed. Similarly, in the second installation part 320, the word "STEP(1) PUSH" indicating an operation of pushing the second installation part 320 against the second insertion groove 82*d* is displayed. The word "STEP(1)" indicates that this step has to be performed prior to releasing operation performed in step S104.

In step S104 (releasing step), the operator detaches the first tube holding member 210, which has been inserted in the first insertion groove 82*c*, from the first installation part 310, detaches the second tube holding member 220, which has been inserted in the second insertion groove 82*d*, from the second installation part 320, and releases the state where the third region A3 of the tube 200 is supported by the support face 331.

The operator moves the tube holding device 300 illustrated in FIG. 12 from the other end 302 toward the one end 301 and thereby releases the state where the third region A3 of the tube 200 is supported by the support face 331. Once the state where the third region A3 is supported by the support face 331 is released, the third region of the tube 200 is guided from the recess 82*b* to the accommodation part 82 so as to come into contact with the inner circumferential face 82*a*. As discussed above, the tube 200 is installed to the tube pump 100 by using the tube holding device 300.

As illustrated in FIG. 12, the word "STEP(2) DOWN" indicating operation to move the tube holding device 300 downward from the other end 302 toward the one end 301, and the arrow directed from the other end 302 toward the one end 301 are displayed on the other end 302 side of the tube holding device 300. The word "STEP(2)" indicates that this step has to be performed after the insertion operation performed in step S103.

The effects and advantages achieved by the tube holding device 300 of the present embodiment described above will be described.

According to the tube holding device 300 of the present embodiment, the first tube holding member 210 configured to hold the first region A1 of the tube 200 is installed to the first installation part 310, and the second tube holding member 220 configured to hold the second region A2 of the tube 200 is installed to the second installation part 320. In this state, a part of the outer circumferential face 201 of the tube 200 is supported by the support face 331 of the support part 330 in the third region A3 of the tube 200 between the first region A1 and the second region A2. Since the support face 331 has a substantially semicircular shape, this results in a state where substantially a half of the region on the outer circumferential face 201 of the third region A3 of the tube 200 is supported by the support face 331. Accordingly, the tube 200 is maintained in a constant shape from the first region A1 to the second region A2 without causing deformation such as twisting of the tube 200.

Further, according to the tube holding device 300 of the present embodiment, in a state where the tube 200 has been moved to a desired position for installation to the tube pump 100, the first tube holding member 210 is detached from the first installation part 310, the second tube holding member 220 is detached from the second installation part 320, and thereby the state where a part of the outer circumferential face 201 of the third region A3 of the tube 200 is supported by the support face 331 is released. This enables the operator to easily perform the operation to install the tube 200 at a desired position of the tube pump 100.

According to tube pump 100 of the present embodiment, it is possible to install the tube 200 to the tube holding device 300 by inserting the first tube holding member 210 into the first insertion hole 311 from the other end 302 side toward the one end 301 side in the longitudinal direction LD and inserting the second tube holding member 220 into the second insertion hole 321 from the other end 302 side toward the one end 301 side in the longitudinal direction LD. Further, since the first installation part 310 has the first wall part 312, this inhibits the first tube holding member 210 inserted in the first insertion hole 311 from moving from the other end 302 side to the one end 301 side. Similarly, since the second installation part 320 has the second wall part 322, this inhibits the second tube holding member 220 inserted in the second insertion hole 321 from moving from the other end 302 side to the one end 301 side.

According to the tube pump 100 of the present embodiment, when the tube holding device 300 is moved from the other end 302 side toward the one end 301 side in the longitudinal direction LD in a state where the positions of the first tube holding member 210 and the second tube holding member 220 are fixed, the first tube holding member 210 comes out of the first insertion hole 311, and the state where the first tube holding member 210 is installed to the first installation part 310 is released. Similarly, the second tube holding member 220 comes out of the second insertion hole 321, and the state where the second tube holding member 220 is installed to the second installation part 320 is released.

Then, the first tube holding member 210 is detached from the first installation part 310, the second tube holding member 220 is detached from the second installation part 320, and thereby the state where a part of the outer circumferential face 201 of the third region A3 of the tube 200 is supported by the support face 331 is released. This enables the operator to easily perform the operation to install the tube 200 at a desired position of the tube pump 100 via an easy operation of moving the tube holding device 300 from the other end 302 side toward the one end 301 side in the longitudinal direction LD.

According to the tube holding device 300 of the present embodiment, the support part 330 is arranged at a position offset from the first installation part 310 and the second installation part 320 in the height direction HD. Thus, at a position where the third region A3 of the tube 200 is suitably spaced apart from the tube pump 100, the operator is able to release the state where the third region A3 of the tube 200 is supported by the support face 331.

According to the tube holding device 300 of the present embodiment, since the first installation part 310, the second installation part 320, the support part 330, and the main body 340 are integrally formed of a resin material, it is possible to easily and reliably hold the tube 200 without performing another operation of positioning of each part or the like.

The tube pump system of the present embodiment includes the tube 200, the tube pump 100, the tube holding device 300, the first tube holding member 210, and the second tube holding member 220. According to the tube pump system of the present embodiment, the first tube holding member 210 configured to hold the first region A1 of the tube 200 is installed to the first installation part 310, and the second tube holding member 220 configured to hold the second region A2 of the tube 200 is installed to the second installation part 320. In this state, a part of the outer circumferential face 201 of the tube 200 is supported by the support face 331 of the support part 330 in the third region A3 of the tube 200 between the first region A1 and the second region A2. Since the support face 331 has a substantially semicircular shape, this results in a state where substantially a half of the region on the outer circumferential face 201 of the third region A3 of the tube 200 is supported by the support face 331. Accordingly, the tube 200 is maintained in a constant shape from the first region A1 to the second region A2 without causing deformation such as twisting of the tube 200.

Further, according to the tube pump system of the present embodiment, the insertion operation to insert the first tube holding member 210 installed to the first installation part 310 of the tube holding device 300 into the first insertion groove 82*c* and the insertion operation to insert the second tube holding member 220 installed to the second installation part 320 of the tube holding device 300 into the second insertion groove 82*d* can be performed at the same time.

Then, when the tube holding device 300 is moved from the other end 302 side toward the one end 301 side in the longitudinal direction LD in a state where the positions of the first tube holding member 210 and the second tube holding member 220 are fixed to the accommodation part 82 of the tube pump 100, the first tube holding member 210 comes out of the first insertion hole 311, and the state where the first tube holding member 210 is installed to the first installation part 310 is released. Similarly, the second tube holding member 220 comes out of the second insertion hole 321, and the state where the second tube holding member 220 is installed to the second installation part 320 is released.

Then, the first tube holding member 210 is detached from the first installation part 310, the second tube holding member 220 is detached from the second installation part 320, and thereby the state where a part of the outer circumferential face 201 of the third region A3 of the tube 200 is supported by the support face 331 is released. This enables the operator to easily perform the operation to install the tube 200 at a desired position of the tube pump 100 via an easy operation of moving the tube holding device 300 from the other end 302 side toward the one end 301 side in the longitudinal direction LD.

According to the tube installation method of the present embodiment, in the installation step (S102), the first tube holding member 210 configured to hold the first region A1 of the tube 200 is installed to the first installation part 310, and the second tube holding member 220 configured to hold the second region A2 of the tube 200 is installed to the second installation part 320. In this state, a part of the outer circumferential face 201 of the tube 200 is supported by the support face 331 of the support part 330 in the third region A3 of the tube 200 between the first region A1 and the second region A2. Since the support face 331 has a substantially semicircular shape, this results in a state where substantially a half of the region on the outer circumferential face 201 of the third region A3 of the tube 200 is supported by the support face 331. Accordingly, the tube 200 is maintained in a constant shape from the first region A1 to the second region A2 without causing deformation such as twisting of the tube 200.

Further, according to the tube installation method of the present embodiment, in the insertion step (step S103), the insertion operation to insert the first tube holding member 210 installed to the first installation part 310 of the tube holding device 300 into the first insertion groove 82*c* and the insertion operation to insert the second tube holding member 220 installed to the second installation part 320 of the tube holding device 300 into the second insertion groove 82*d* can be performed at the same time.

Then, the first tube holding member 210 is detached from the first installation part 310, the second tube holding member 220 is detached from the second installation part 320, and thereby the state where a part of the outer circumferential face 201 of the third region A3 of the tube 200 is supported by the support face 331 is released. This enables the operator to easily perform the operation to install the tube 200 at a desired position of the tube pump 100.

What is claimed is:

1. A tube holding device configured to hold a tube to be installed to a tube pump, the tube holding device comprising:

a first installation part to which a first tube holding member configured to hold a first region of the tube is detachably installed;

a second installation part to which a second tube holding member configured to hold a second region of the tube is detachably installed, the second region being different from the first region; and a support part having a support face in a third region of the tube between the first region and the second region with the first tube holding member being installed to the first installation part and the second tube holding member being installed to the second installation part, the support face being configured to support a part of an outer circumferential face of the tube and having a substantially semicircular shape in sectional view, wherein the first installation part and the second installation part are arranged on one end side in a longitudinal direction of the tube holding device, wherein the support part is arranged on the other end side in the longitudinal direction so that the support face faces the other end side in the longitudinal direction, wherein the first installation part has a first insertion hole configured such that the first tube holding member is inserted in the first insertion hole from the other end side to the one end side in the longitudinal direction and a first wall part configured to inhibit the first tube holding member inserted in the first insertion hole from moving from the other end side to the one end side, and wherein the second installation part has a second insertion hole configured such that the second tube holding member is inserted in the second insertion hole from the other end side to the one end side in the longitudinal direction and a second wall part configured to inhibit the second tube holding member inserted in the second insertion hole from moving from the other end side to the one end side.

2. The tube holding device according to claim 1, wherein the first installation part and the second installation part are arranged apart from each other in a width direction orthogonal to a longitudinal direction of the tube holding device, and wherein the support part is arranged at a position offset from the first installation part and the second installation part in a height direction orthogonal to the longitudinal direction and the width direction.

3. The tube holding device according to claim 1 further comprising a main body to which the first installation part, the second installation part, and the support part are connected, respectively, wherein the first installation part, the second installation part, the support part, and the main body are integrally formed of a resin material.

4. A tube pump system comprising:

a tube;

a tube pump configured to transport a liquid inside the tube;

a tube holding device configured to hold the tube to be installed to the tube pump;

a first tube holding member configured to hold a first region of the tube; and a second tube holding member configured to hole a second region of the tube, the second region being different from the first region, wherein the tube pump has an accommodation part having an inner circumferential face for the tube to be arranged in an arc shape about an axis, and a roller part accommodated in the accommodation part and configured to be rotated about the axis with the tube being blocked, wherein a first insertion groove in which the first tube holding member is inserted and a second insertion groove in which the second tube holding member is inserted are formed in the accommodation part, wherein the tube holding device has a first installation part to which the first tube holding member is detachably installed, a second installation part to which the second tube holding member is detachably installed, and a support part having a support face in a third region of the tube between the first region and the second region with the first tube holding member being installed to the first installation part and the second tube holding member being installed to the second installation part, the support face being configured to support a part of an outer circumferential face of the tube and having a substantially semicircular shape in sectional view, and wherein the first tube holding member is installed to the first installation part and the second tube holding member is installed to the second installation part so that an insertion operation to insert the first tube holding member installed to the first installation part into the first insertion groove and an insertion operation to insert the second tube holding member installed to the second installation part into the second insertion groove are able to be performed at the same time.

5. A tube installation method for installing a tube to a tube pump by using a tube holding device, wherein the tube holding device has a first installation part to which a first tube holding member configured to hold a first region of the tube is detachably installed, a second installation part to which a second tube holding member configured to hold a second region of the tube is detachably installed, the second region being different from the first region, and a support part having a support face in a third region of the tube between the first region and the second region with the first tube holding member being installed to the first installation part and the second tube holding member being installed to the second installation part, the support face being configured to support a part of an outer circumferential face of the tube and having a substantially semicircular shape in sectional view, wherein the tube pump has an accommodation part having an inner circumferential face for the tube to be arranged in an arc shape about an axis, and a roller part accommodated in the accommodation part and configured to be rotated about the axis with the tube being blocked, wherein a first insertion groove in which the first tube holding member is inserted and a second insertion groove in which the second tube holding member is inserted are formed in the accommodation part, the tube installation method comprising:

an installation step of installing the first tube holding member to the first installation part and installing the second tube holding member to the second installation part so that an insertion operation to insert the first tube holding member installed to the first installation part into the first insertion groove and an insertion operation to insert the second tube holding member installed to the second installation part into the second insertion groove are able to be performed at the same time;

an insertion step of inserting the first tube holding member installed to the first installation part into the first insertion groove and inserting the second tube holding member installed to the second installation part into the second insertion groove; and a releasing step of detaching, from the first installation part, the first tube holding member inserted in the first insertion groove, detaching, from the second installation part, the second tube holding member inserted in the second insertion groove, and releasing a state where the third region of the tube is supported by the support face.

* * * * *